US007867383B2

(12) United States Patent
Ding

(10) Patent No.: US 7,867,383 B2
(45) Date of Patent: Jan. 11, 2011

(54) METHOD FOR RECOMBINING CATALYTIC HYDROCARBONS

(75) Inventor: Ranfeng Ding, Beijing (CN)

(73) Assignee: Beijing Grand Golden-Bright Engineering and Technologies Co., Ltd., Beijing (CN)

( * ) Notice: Subject to any disclaimer, the term of this patent is extended or adjusted under 35 U.S.C. 154(b) by 994 days.

(21) Appl. No.: 10/563,351

(22) PCT Filed: Jul. 2, 2004

(86) PCT No.: PCT/CN2004/000723

§ 371 (c)(1),
(2), (4) Date: Jan. 17, 2007

(87) PCT Pub. No.: WO2005/003261

PCT Pub. Date: Jan. 13, 2005

(65) Prior Publication Data

US 2007/0175800 A1 Aug. 2, 2007

(30) Foreign Application Priority Data

Jul. 4, 2003 (CN) ..... 03 1 48181
Nov. 7, 2003 (CN) ..... 2003 1 0103540
Nov. 7, 2003 (CN) ..... 2003 1 0103541

(51) Int. Cl.
*C10G 21/28* (2006.01)

(52) U.S. Cl. ..... 208/313

(58) Field of Classification Search ..... 208/106, 208/113–124, 308, 311, 313
See application file for complete search history.

(56) References Cited

U.S. PATENT DOCUMENTS 2,773,006 A * 12/1956 Carver et al. ..... 208/313
5,021,143 A * 6/1991 Franckowiak et al. ..... 208/315

* cited by examiner

*Primary Examiner*—Glenn Caldarola
*Assistant Examiner*—Randy Boyer
(74) *Attorney, Agent, or Firm*—Ladas & Parry LLP

(57) ABSTRACT

A process for catalytic hydrocarbon recombination is disclosed, in which catalytic hydrocarbons are fractionated at fractionators to fractionate a gasoline fraction and a diesel fuel fraction, an intermediate fraction is drawn; the intermediate fraction or the mixture of the intermediate fraction and the gasoline fraction are treated for aromatic hydrocarbon extraction to get aromatic hydrocarbon fraction and non-aromatic hydrocarbon fraction; the aromatic hydrocarbon fraction are fractionated, and the high octane number gasoline fraction obtained are blended with gasoline fraction to increase the octane number of the gasoline; the non-aromatic hydrocarbon fraction are fractionated, and the diesel fuel fraction obtained are blended with the diesel fuel fraction to increase the diesel fuel output and the cetane number of the diesel fuel. In comparison with the prior art, the recombination process of the present invention has low limitation to the raw material, low capital cost, low operation cost, and increases the types of the products.

31 Claims, 8 Drawing Sheets

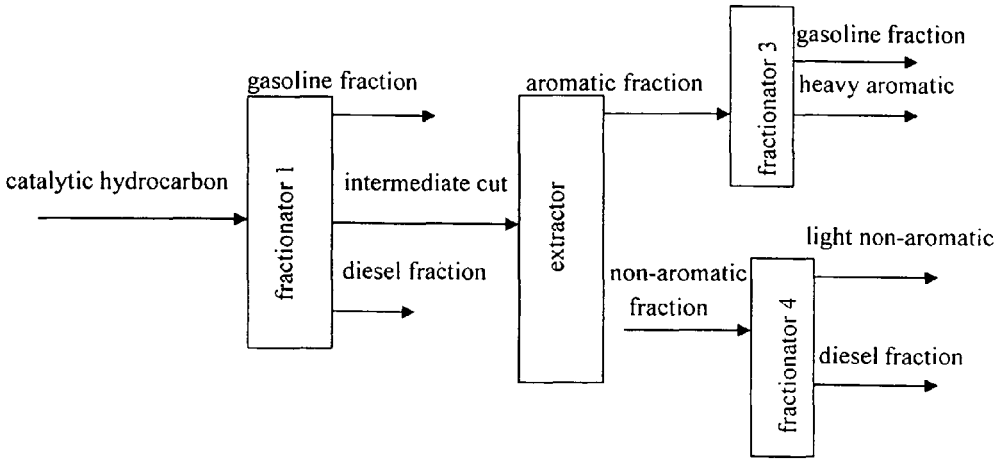
FIG.1-A
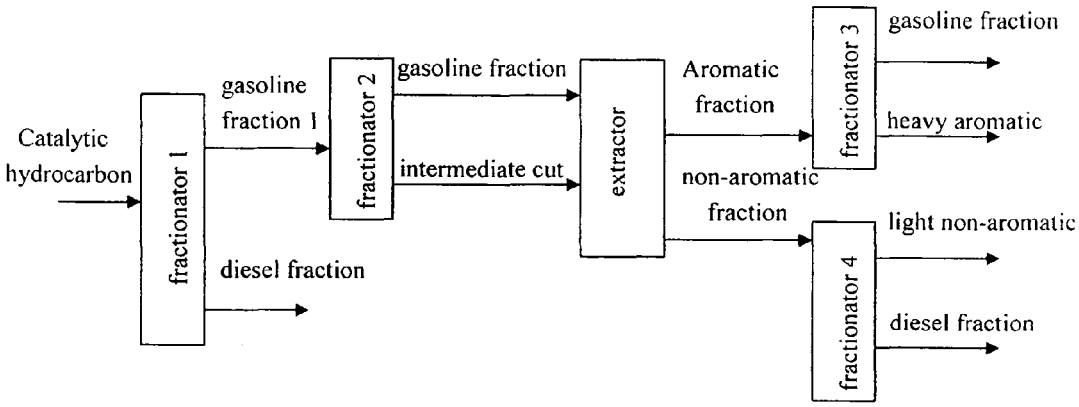
FIG. 2-A
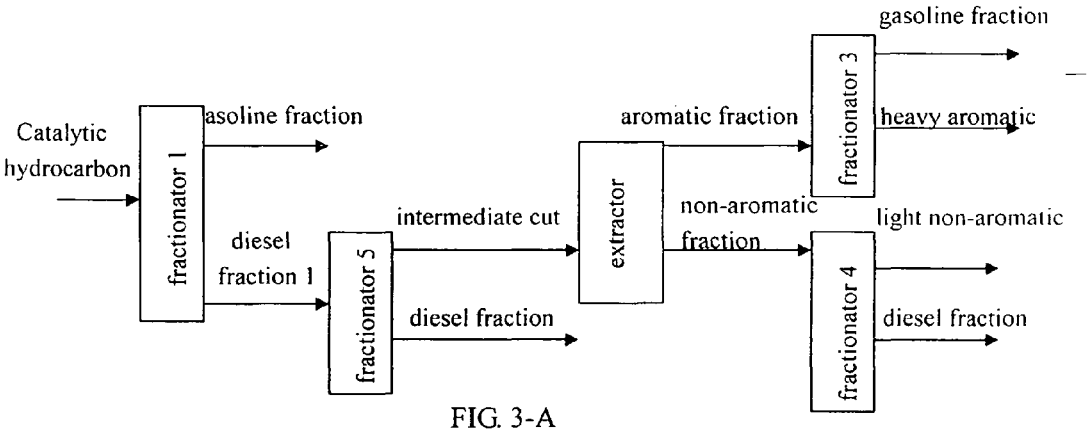
FIG. 3-A

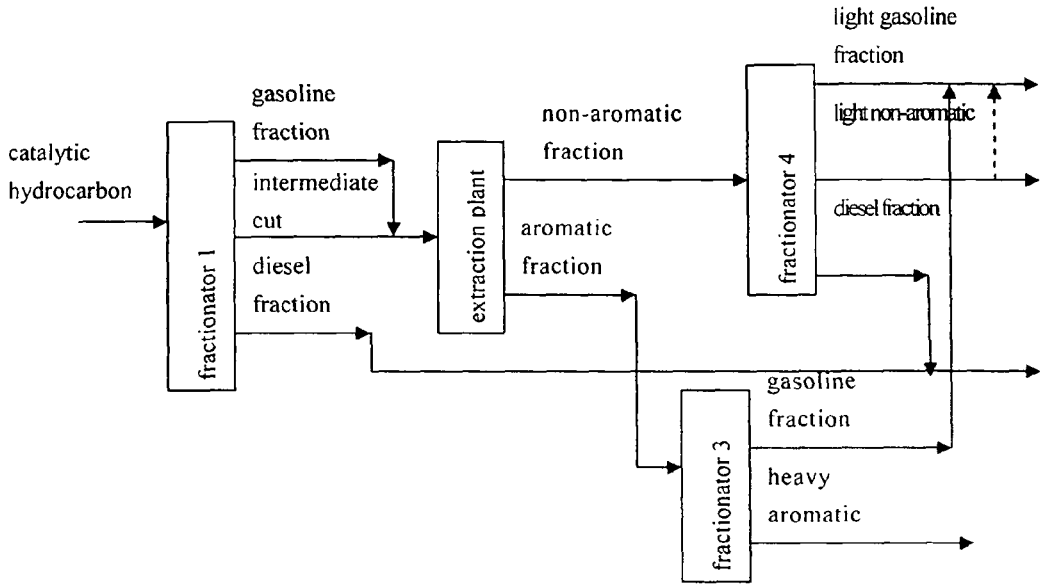
FIG. 1-B
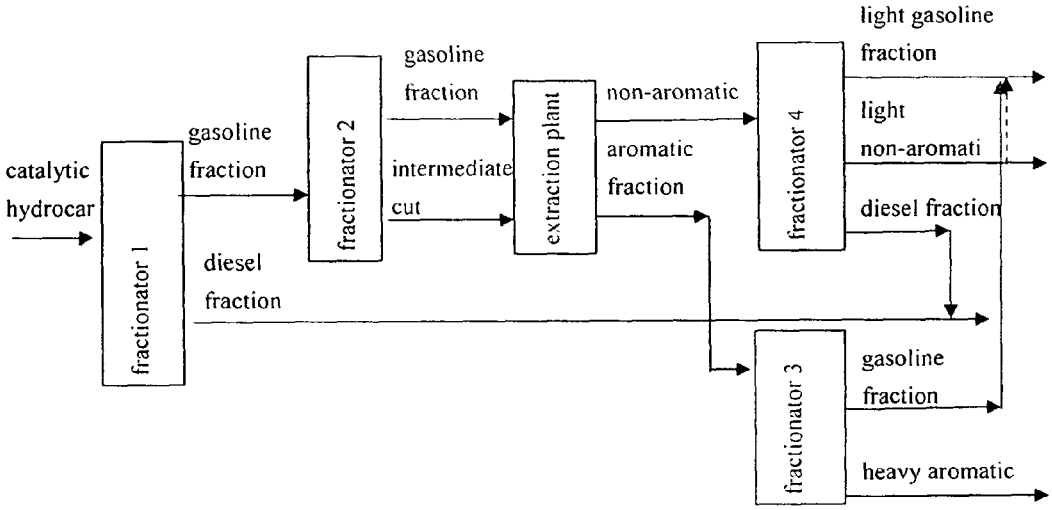
FIG. 2-B

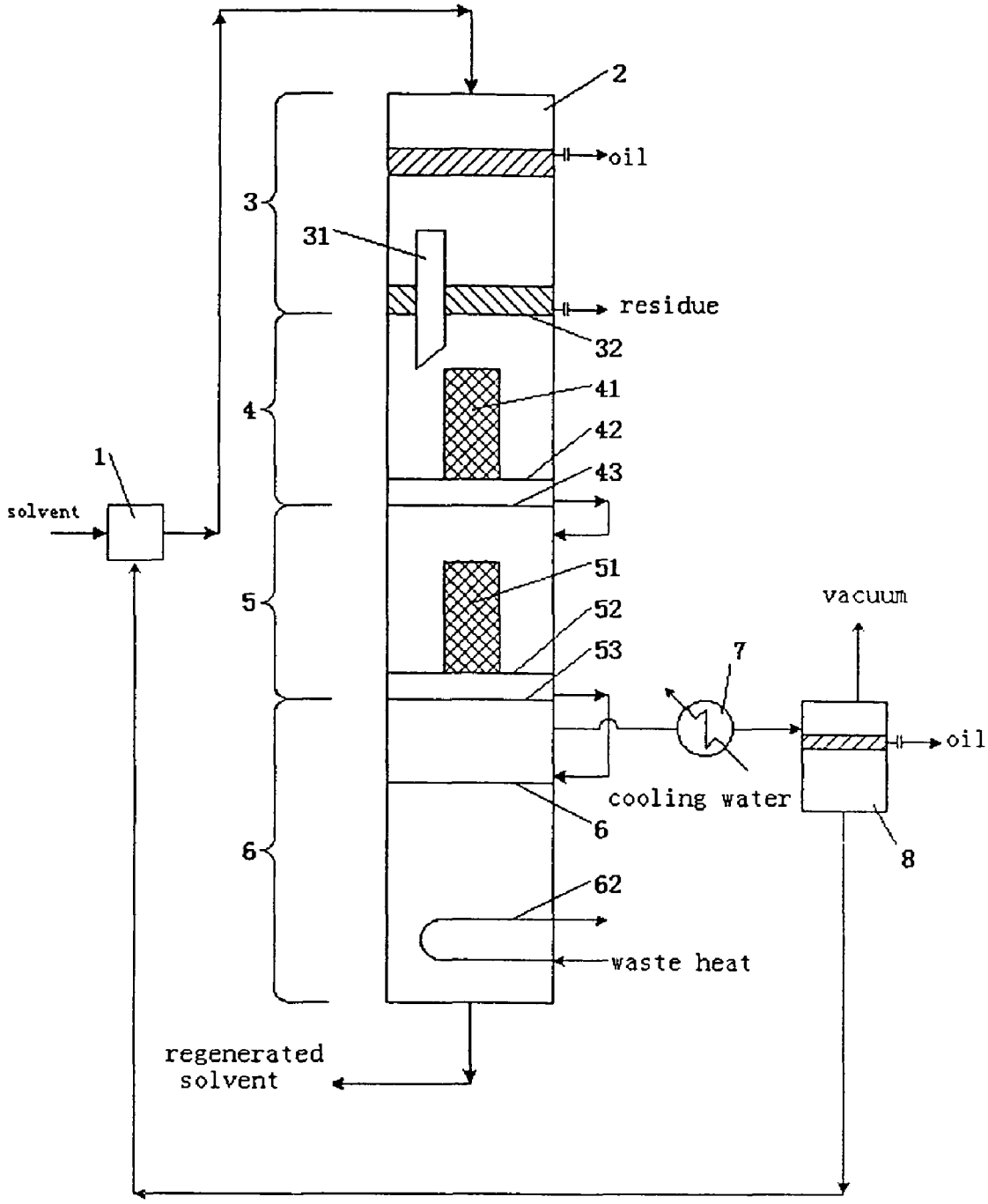
FIG. 1-C

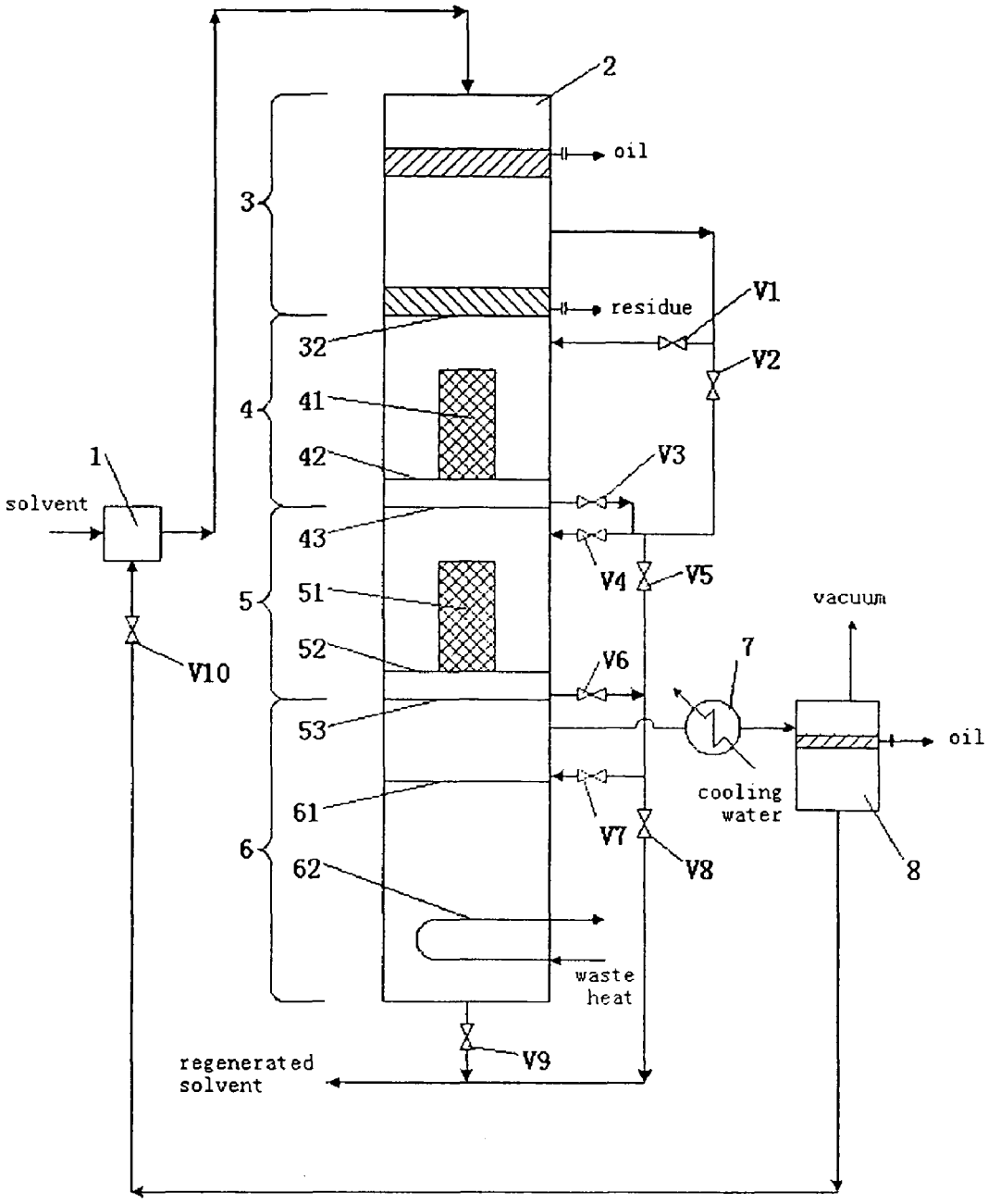
FIG. 2-C

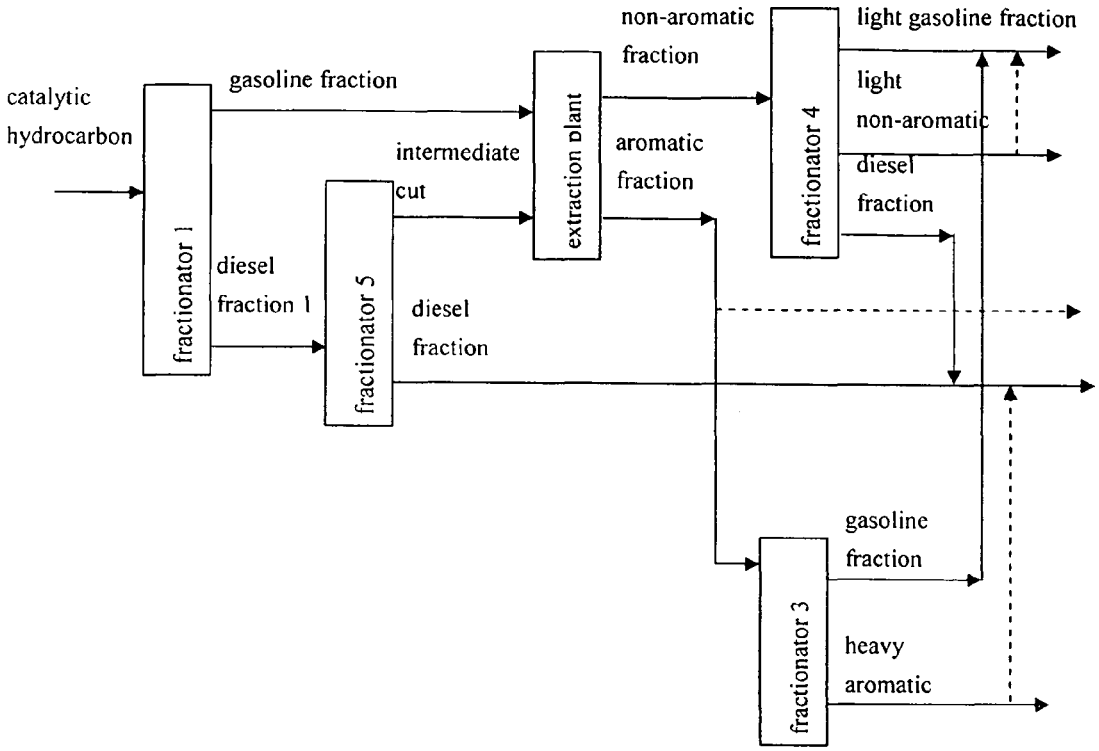
FIG. 3-B

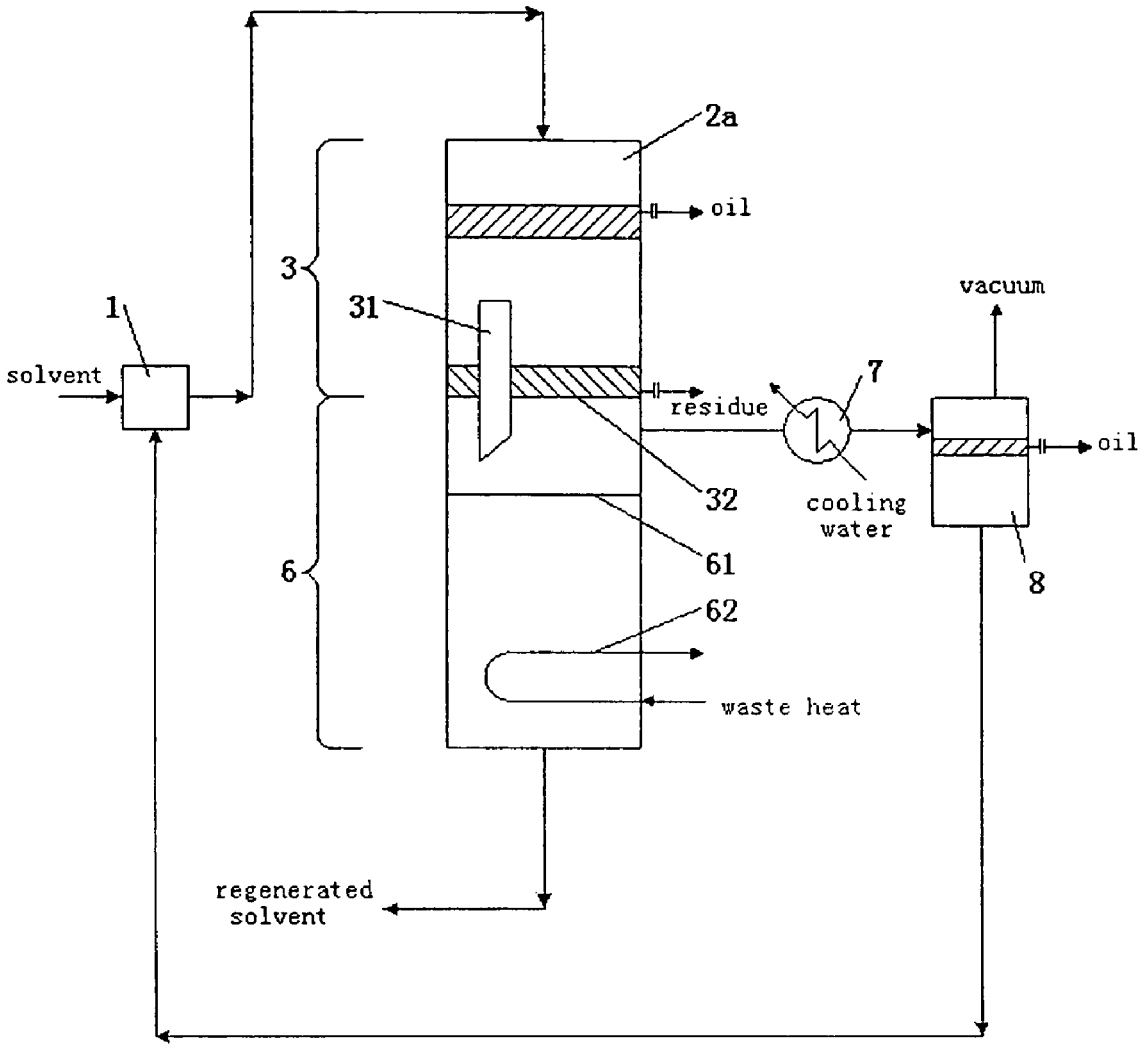
FIG. 3-C

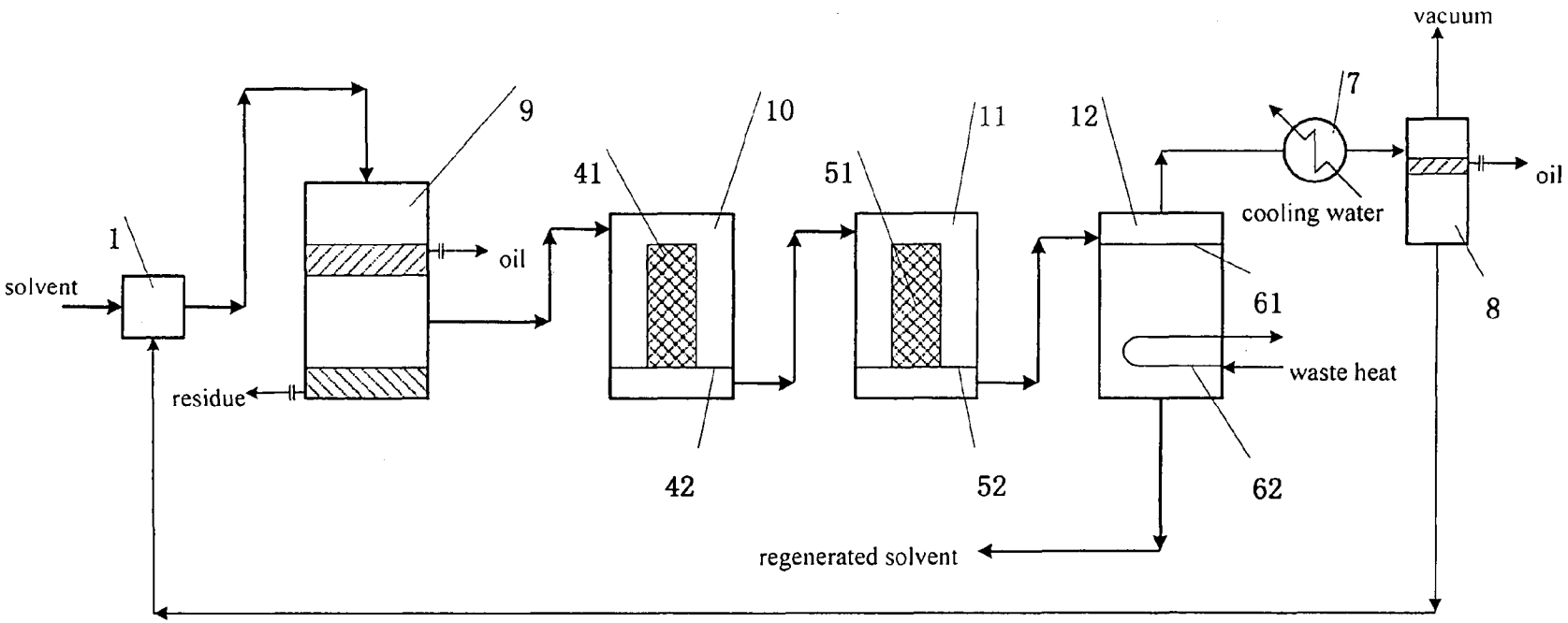
FIG. 4-C

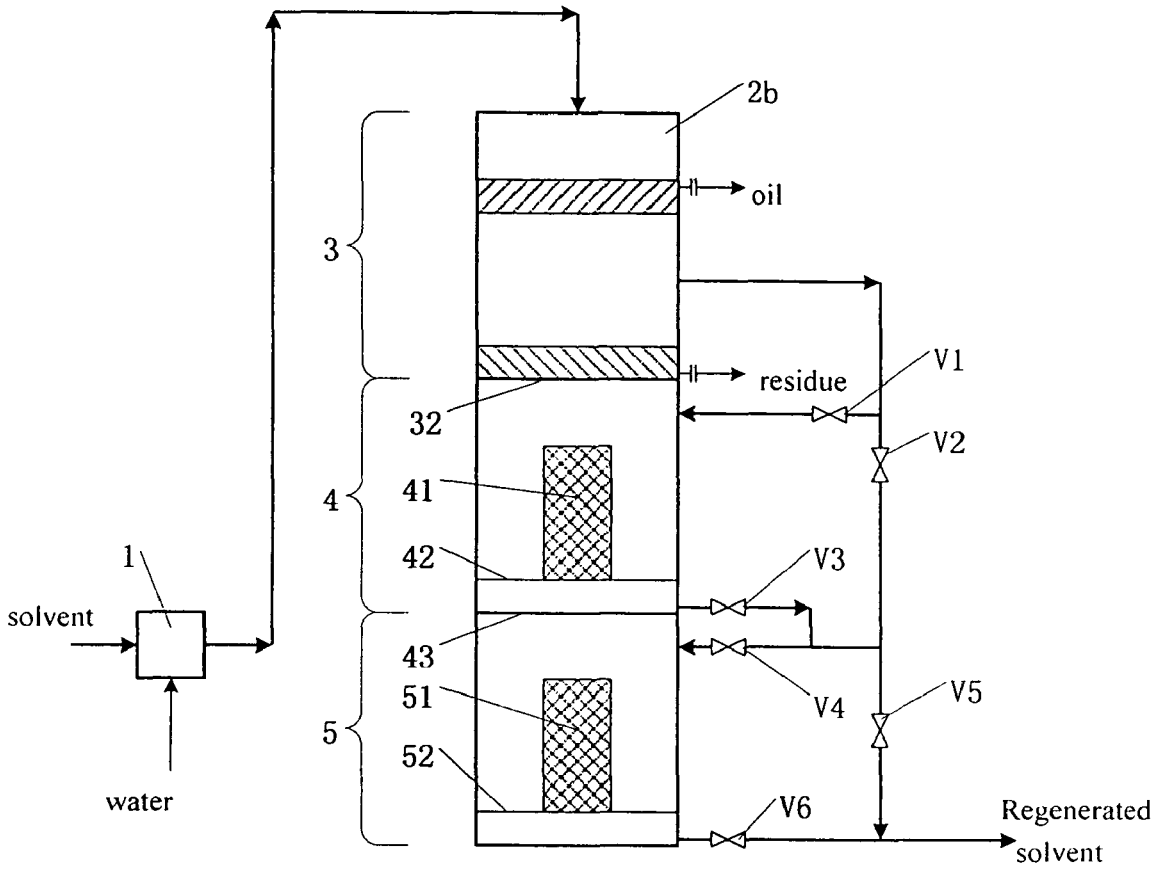
FIG. 5-C

METHOD FOR RECOMBINING CATALYTIC HYDROCARBONS

BACKGROUND OF THE INVENTION

1. Field of the Invention

The present invention relates to a process for catalytic hydrocarbon recombination, and more particularly to a process for catalytic hydrocarbon recombination for preparing high quality gasoline and diesel fuel.

2. Description of the Related Art

Catalytic cracking, heavy oil catalytic cracking technology is the key technology of oil refining. Catalytic cracking includes wax oil catalytic cracking, heavy oil catalytic cracking; the oils produced by this process are called catalytic hydrocarbons. When processed, normally through a fractionator, the resulting catalytic hydrocarbons may produce dry gas, gasoline, diesel fuel, heavy oil, etc., where gasoline and diesel fuel is up to 70% of the market gasoline and diesel fuel share.

As environmental protection requirements getting increasingly stringent, the standards of the gasoline and diesel fuel become higher and higher. The existing fractionation process for catalytic hydrocarbon has the following deficiency: First, the quality of the gasoline and diesel fuel produced by the existing process is to be improved; the olefin content of the gasoline is too high, octane number is too low, the cetane number of the diesel fuel is too low, and it can not meet the stabilization requirement; Secondly, the existing process is not available for producing various grade of gasoline at the same time, the grade of the products is too narrow; third, the ratio of the gasoline and diesel fuel produced does not match the market requirement, insufficient for the demand of diesel fuel but over sufficient for the demand of gasoline.

The main factor which impacts the quality of the gasoline is the olefin content and the octane number of the gasoline. Recently, the methods taken by oil refining plants to increase the octane number are: 1. Increase high octane number gasoline regulating fraction, such as recombined resulting oil, alkylate, etherized resulting oil, isomerized resulting oil, etc.; 2. Use new catalysts; 3. Adjust the operating condition of catalytic cracking; 4. Adjusting the fractionation rang of gasoline.

The following issues are found from the above methods: 1. High capital cost, high operation cost, capacity limited by the feedstock, and unreasonable use of resource, for example, since recombined resulting oil is the main feed for the polyester, it maximizes the shortage of the polyester feed when large amount of recombined resulting oil is used as high octane gasoline blending fraction; 2. Use of new catalysts could increase the octane number, but it will lead to higher olefin content of the gasoline and decrease the diesel fuel and gasoline ratio; 3. Measures to adjust the operating condition of catalytic cracking and to increase the octane number could also lead to higher olefin content in the gasoline and lower the diesel fuel and gasoline ratio; 4. Measures to adjust the fractionation rang and to get higher octane number will also lead to higher olefin content in the gasoline, even if the adjusting margin is limited. All the methods used to get higher octane number by increasing the olefin content of the gasoline have conflict with execution of new gasoline standard.

The solvent used in the solvent extracting tower to extract the aromatic hydrocarbon composition and non-aromatic hydrocarbon composition is recycled, and it is intersoluble with water. When having recycled in the equipments for a long time, part of the solvent inevitably produces acidic material due to oxidization. Anti-acid is added to remove the acidic material. In the above process, trace olefin can be carried in the feed. In addition, mechanical contaminants can also be generated in the equipments and piping. The color of the recycle solvent will get darker and darker, and high polymer and acidic material accumulate continuously, it will impact the operation of the above process little by little, in the case of serious, it will impact the quality and yield of the product. Therefore, the recycle solvent must be regenerated.

The current solvent regeneration methods include atmosphere or vacuum stripping regeneration, atmosphere or vacuum distillation regeneration, adsorption regeneration and filtration regeneration. The stripping regeneration capacity is low due to the limitation of the stripping gas rate; the operation of the distillation regeneration is too complicated, large amount of solvent is lost, the energy consumption is high, and severe coking is found at the reboiler of the regenerator. Ion exchange resin is commonly used for adsorption regeneration, such as the sulfolane extracting system recycle water regeneration proposed by U.S. Pat. No. 4,919,816. This method can remove the acidic material of the recycle water, minimize the corrosion of the equipment, but can not remove the contaminant of the solvent system. Moreover, alkali solution is required. Chinese patent CN1062007C disclosed a regeneration method of aromatic extraction solvent. This regeneration approach is achieved by adding recycle water to the system, then by filtration and adsorption de-colure. It's disadvantages are as follows: first, the water amount in the system is limited, so it will limit the process capacity; secondly, after the water is added, the contaminant of the solvent can not be isolated before going into the adsorption bed, so fouling frequently happens at the adsorption bed; third, the adsorption bed fail when up to a certain extent due to the limitation of the adsorption capacity of the adsorption bed, so replacement or regeneration of the sorbent is required; fourth, acid and alkali treatment is required for resin regeneration, the operation is complex and it leads to higher cost.

SUMMARY OF THE INVENTION

It is an object of the present invention to provide a process for catalytic hydrocarbon recombination to produce high quality gasoline and diesel fuel.

Another object of the invention is to, provide a process for catalytic hydrocarbon recombination with a water-soluble solvent regeneration system, in which the solvent loss is low, the process capacity is strong, no acid and alkali treatment is required, and the quality of the regenerated solvent is high.

A further object of the invention is to produce various grade of gasoline and diesel fuel at the same time through catalytic hydrocarbon recombination, thus to increase the types of the products.

A yet another object of this invention is to increase the diesel fuel and gasoline ratio to meet the market demand.

To attain the above objects, this invention adopts the following technical scheme:

A process for catalytic hydrocarbon recombination, in which catalytic hydrocarbon is fractionated at fractionator 1, including fractionating gasoline fraction and diesel fuel fraction; characterized in that: recombine the gasoline fraction and diesel fuel fraction, and draw an intermediate fraction from the gasoline fraction and diesel fuel fraction; extract the above intermediate fraction at a solvent extractor to separate the aromatic and non-aromatic fraction.

One preferred scheme, wherein the intermediate fraction is drawn at one for more side cuts added at the middle of the fractionator 1. The overhead temperature of the fractionator 1 is 65~95° C., the outlet temperature of diesel fuel is 190~280°

C., the temperature of side cut is 120~260° C., the bottom temperature is 340~385° C., the overhead pressure of the fractionator 1 is 0.11~0.28 MPa, the bottom pressure is 0.12~0.30 MPa; the gasoline fraction, diesel fuel fraction and intermediate fraction are produced at fractionator 1; the distillation range of the gasoline fraction is controlled at 35~110° C.±30° C., the distillation range of the diesel fuel fraction is controlled at 210° C.±30° C.~355±30° C., the fractionation rang of the mentioned intermediate fraction is controlled at 120° C.±30° C.~210±30° C.

One preferred scheme, wherein it is a two-step fractionation: step 1, fractionate a gasoline fraction and a diesel fuel fraction first, increase the temperature of the fractionator 1 by 10~50° C., and the fraction rang of the gasoline is controlled at 35~210° C.±30° C., the fraction rang of the diesel fuel is controlled at 210° C.±30° C.~355±30° C.; Then pump the gasoline fraction to fractionator 2 to proceed the second fractionation, draw the intermediate fraction of 110° C.±30° C.~210±30° C. at the bottom of the fractionator 2, and separate the gasoline fraction of 35~110° C.±30° C. at the overhead.

One preferred scheme, wherein it is a two step fractionation, step 1, fractionate gasoline and diesel fuel fraction first, decrease the temperature of the fractionator 1 to 10~40° C., the fraction rang of the gasoline is controlled at 35~110° C.±30° C., and the fraction rang of the diesel fuel is controlled at 110° C.±30° C.~355±30° C.; then pump the diesel fuel fraction to fractionator 5 to proceed the second fractionation, draw the diesel fuel fraction of 210° C.±30° C.~355±30° C. at the bottom of the fractionator 5, and separate the intermediate fraction of 110° C.±30° C.~210±30° C. at the overhead.

One preferred scheme, wherein the aromatic hydrocarbon fraction is fractionated at fractionator 3, high octane number gasoline fraction is separated at overhead of fractionator 3, heavy aromatic is separated at the bottom, and blend the resulting high octane number gasoline fraction with the 35~110° C.±30° C. gasoline.

One preferred scheme, wherein the high octane number gasoline may be blended with 35~110° C.±30° C. gasoline completely.

One preferred scheme, wherein the high octane number gasoline may be blended with 35~110° C.±30° C. gasoline based on setting values to get different grade gasoline such as 90#, 93#, 97# gasoline.

One preferred scheme, wherein it is a one step fractionation process, the intermediate fraction is drawn at 1 or 4 side cuts, thus dividing the intermediate fraction into 1 to 4 fraction range.

One preferred scheme, wherein the non-aromatic fraction is fractionated at fractionator 4, and the diesel fuel fraction is separated at the bottom of the fractionator 4, and blended with the 210° C.±30° C.~380° C. diesel fuel fraction to increase the cetane number of the diesel fuel, or blending one or more kinds of low condensing point diesel fuel based on the market status. Light non-aromatic hydrocarbons are separated at overhead of fractionator 4. They can be used as chemical light oil, or blended with gasoline.

A process for catalytic hydrocarbon recombination, in which the catalytic hydrocarbon is fractionated at fractionator 1, including fractionating gasoline fraction and diesel fuel fraction; Recombine the gasoline fraction and the diesel fuel fraction, and draw the intermediate fraction from the gasoline fraction and the diesel fuel fraction; wherein the intermediate fraction and the gasoline fraction are pumped to the solvent extraction unit for extraction, so as to separate the aromatic and non-aromatic fraction.

One preferred scheme, wherein the intermediate fraction is drawn at one or more side cuts added at the middle section of the fractionator 1. The overhead temperature of the fractionator 1 is 65~130° C., the outlet temperature of diesel fuel is 170~250° C., the side cut temperature is 120~240° C., the bottom temperature is 330~385° C., the overhead pressure of the fractionator 1 is 0.15~0.28 MPa, and the bottom pressure is 0.12~0.30 MPa; the gasoline fraction, the diesel fuel fraction and the intermediate fraction are produced at fractionator 1; the distillation range of the gasoline fraction is controlled at 35~150° C., the distillation range of the diesel fuel fraction is controlled at 170~395° C., and the distillation range of the intermediate fraction is controlled at 70~250° C.

One preferred scheme, wherein it is a two step fractionation: step 1, fractionate gasoline and diesel fuel fraction first, increase the temperature of the fractionator 1 overhead and diesel fuel outlet by 10~50° C., control the distillation range of the gasoline at 35~250° C., control the distillation range of the diesel fuel at 170~395° C.; Then pump the gasoline fraction to fractionator 2 to proceed the second fractionation, the intermediate fraction of 70~250° C. is drawn at the bottom side cut of the fractionator 2, the 35~150° C. gasoline is separated at the overhead; wherein the intermediate fraction and the 35~150° C. gasoline go to the solvent extraction unit together to separate the aromatic and non-aromatic compositions.

One preferred scheme, wherein it is a two step fractionation: step 1, fractionate gasoline and diesel fuel fraction first, decrease the temperature of the fractionator 1 overhead and diesel fuel outlet by 10~50° C., control the distillation range of the gasoline at 35~150° C., control the distillation range of the diesel fuel at 70~395° C.; Then pump the diesel fuel fraction to fractionator 5 to proceed the second fractionation, the 170~395° C. diesel fuel fraction is drawn at the bottom side cut of the fractionator 5, the 70~250° C. intermediate fraction is fractionated at the overhead; the intermediate fraction and the 170~395° C. diesel fuel go to the solvent extraction unit together to separate the aromatic and non-aromatic compositions.

One preferred scheme, wherein it is a one step fractionation process, the fractionator 1 have 1 or 4 side cuts, so the intermediate fraction can be separated into 1 to 4 stream.

One preferred scheme, wherein the aromatic hydrocarbon fraction and the solvent are fractionated at fractionator 3, high octane number gasoline fraction is separated at overhead of fractionator 3, and heavy aromatic is separated at bottom.

One preferred scheme, wherein the non-aromatic fraction are fractionated at fractionator 4, the overhead product of the fractionator 4 is light gasoline; light non-aromatic hydrocarbons are drawn at the side cut; the diesel fuel fraction are drawn at bottom.

The diesel fuel fraction is blended with the 170~380° C. diesel fuel fraction to increase the cetane number of the diesel fuel; one or more low condensing point diesel fuels and non-low condensing point diesel fuels can also be blended based on the market status; the diesel fuel fraction serve as the feed for ethylene after hydro treating.

The light non-aromatic hydrocarbons may be blended with light gasoline; or it can be used as chemical light oil separately. The aromatic content of the chemical light oil is low; it can be taken as the high quality feed for steam cracker after hydro treating.

The high octane gasoline fraction can be blended with the light gasoline fraction.

The high octane gasoline fraction can be blended with the light gasoline fraction based on setting values to get different types of the gasoline, such as 90#, 93#, and 97#.

The aromatic hydrocarbons can also be used as high quality gasoline. The solvent used for extraction are: sulfones, such as sulfolane; glycols, such as tetraethylene glycol and pentaethylene glycol; Alkyl-alkones, such as N-metyle-pyrrolidone; acidamides; and amines, it can also be the mixture of two solvent or more than two solvents.

A process for catalytic hydrocarbon recombination, in which the catalytic hydrocarbon is fractionated at fractionator 1, including fractionating gasoline fraction and diesel fuel fraction; recombine the gasoline fraction and the diesel fuel fraction, and draw an intermediate fraction from the gasoline fraction and the diesel fuel fraction; the intermediate fraction or the mixture of the intermediate fraction and the gasoline fraction are extracted at the solvent extractor to separate the aromatic and non-aromatic fraction, wherein the solvent for extraction is recycled, the regeneration procedure of the solvent is detailed as follows:

1. Mix the water-soluble solvent with water, the weight ratio of water and the solvent is 0.1~10;
2. The mixture is separated by sedimentation. Three phases are generated, oil at top, the mixture of water-solvent and water at middle section, and insoluble substance at bottom;
3. The mixed phases of step 2 are fractionated at atmosphere or vacuum condition by utilizing of waste heat, obtaining water-soluble solvent and water;
4. Discharge the regenerated water-soluble solvent of step 3, and cool down the separated water;
5. After the water in step 4 is cool down, reseparate the oil and water, discharge the recovered water, and mix with the water-soluble solvent of step 1 for recycle.

One preferred scheme, wherein at first filtrate the middle mixed phases of step 3, then proceed with distillation.

The weight ratio of water and the water-soluble solvent is preferably 0.5~3; more preferably is 1~2;

One preferred scheme, wherein the filtration separation can be 1-stage filtration, 2-stage filtration or 3-stage filtration, each filtration stage can be used in series, in parallel or in combination thereof.

The material used in filtration can be filter element, or filter packing. Filter element can employ materials of specific apertures, including metal powder metallurgy, ceramic, metal mesh and various fabrics etc. Filter packing includes active carbon, or treated active carbon, clay, silica gel, silicon oxide, alumina, molecular sieve, various mineral, such as sand, etc., and various cation and anion exchange resins.

BRIEF DESCRIPTION OF THE DRAWINGS

FIG. 1-A is a schematic flow diagram of the Embodiment 1-A of the invention;

FIG. 2-A is a schematic flow diagram of the Embodiment 5-A of the invention;

FIG. 3-A is a schematic flow diagram of the Embodiment 4-A of the invention;

FIG. 1-B is a schematic flow diagram of the Embodiment 1-B of the invention;

FIG. 2-B is a schematic flow diagram of the Embodiment 4-B of the invention;

FIG. 3-B is a schematic flow diagram of the Embodiment 5-B of the invention;

FIG. 1-C is a schematic flow diagram of the Embodiment 1-C of the invention;

FIG. 2-C is a schematic flow diagram of the Embodiment 2-C of the invention;

FIG. 3-C is a schematic flow diagram of the Embodiment 3-C of the invention;

FIG. 4-C is a schematic flow diagram of the Embodiment 4-C of the invention;

FIG. 5-C is a schematic flow diagram of the Embodiment 5-C of the invention;

Further description is given by the following embodiments, but it is not intended to limit the scope of the invention.

DETAILED DESCRIPTION OF THE PREFERRED EMBODIMENTS

Comparison Embodiment 1-A

The paraffine-based catalytic feed and the feedback oil produce catalytic hydrocarbon under the catalysis of the LCS catalyst produced by Lanzhou Catalyst Plant, China. The resulting catalytic hydrocarbon is catalytic cracking wax oil. It is fractionated at the fractionator 1. The overhead temperature of the fractionator 1 is 110° C., the diesel fuel outlet temperature is 190° C., the bottom temperature is 370° C., the overhead pressure is 0.11 MPa, the bottom pressure is 0.12 MPa. The fractions are dry gas, liquid gas, gasoline, diesel fuel, heavy oil etc.

Embodiment 1-A

See FIG. 1-A, the paraffine-based catalytic feed and the feedback oil produce catalytic hydrocarbon under there catalysis of LCS catalyst produced by Lanzhou Catalyst Plant, China. It is fractionated at the fractionator 1. The overhead temperature of the fractionator 1 is 80° C., the diesel fuel outlet temperature is 240° C., the bottom temperature is 370° C., the overhead pressure is 0.1 MPa, the bottom pressure is 0.12 MPa; One side cut is added at the middle section of the fractionator 1 to draw the intermediate fraction. The side cut temperature is 190° C., the distillation range of the intermediate fraction is 120~210° C. The intermediate fraction is pumped to an extractor for solvent extraction, the solvent used is sulfolane, the extraction temperature is 80° C., and the extraction pressure is 0.4 MPa. Solvent weight ratio (solvent/feed) is 4.8. Aromatic and non-aromatic hydrocarbons are separated; The aromatic hydrocarbon gofraction go to the middle section of fractionator 3 for distillation, the distillation temperature is 120~165° C., and the distillation pressure is 0.04~0.20 MPa, stripping water goes in at the bottom, the overhead fraction is high octane number fraction, the lower side cut is heavy aromatic hydrocarbon fraction, the bottom cut is the recycle solvent; All the high octane number fractions are blended with gasoline fraction; the non-aromatic hydrocarbon fraction go to the fractionator 4 at the middle section for distillation. The distillation temperature is 100~135° C., the pressure is 0.15~0.25 MPa, the overhead cut is light non-aromatic, the bottom cut is diesel fuel; All the diesel fuels are blended with the diesel fuel fraction; the Light non-aromatic hydrocarbons are blended with the gasoline fraction.

Embodiment 2-A

The intermediate base atmosphere residual heavy oil catalytic feed and the feedback oil produce the catalytic hydrocarbon under the catalysis of LANET-35 catalyst produced by Lanzhou Catalyst Plant, China. The catalytic hydrocarbon is catalytic cracking heavy oil. It is fractionated at the fractionator 1. The overhead temperature of the fractionator 1 is 80° C., diesel fuel outlet temperature is 240° C., bottom temperature is 370° C., overhead pressure is 0.1 MPa, bottom pressure is 0.12 MPa; three side cuts are added at the middle section of the fractionator 1 to draw the intermediate fraction. The three side cut temperature from up to down is 170, 180, 190° C., the distillation range of the intermediate fraction is 80~120° C., 120~165° C., 165~220° C., the intermediate fraction got from the three distillation range is pumped to the same extractor for solvent extraction. The solvent is tetraethylene glycol, the extraction temperature is 85° C., and the extraction pressure is 0.4 MPa. Solvent weight ratio (solvent/feed) is 3.1. Aromatic and non-aromatic hydrocarbons are separated; The aromatic hydrocarbon gofraction go to the middle section of fractionator 3 after combination for distillation, the distillation temperature is 120~180° C., and the distillation pressure is 0.04~0.20 MPa, stripping water will be feed in at the bottom, the overhead fraction is high octane number fraction, the lower side cut is heavy aromatic hydrocarbon fraction, the bottom cut is the recycle solvent; All the high octane number fractions are blended with gasoline fraction; the non-aromatic hydrocarbon fraction go to the middle section of fractionator 4 after combination for distillation. The distillation temperature is 100~135° C., the pressure is 0.15~0.25 MPa, the overhead cut are light non-aromatic hydrocarbons, the bottom cut are diesel fuels; the diesel fuel fraction is blended with the diesel fuel fraction completely; the Light non-aromatic hydrocarbons are blended with the gasoline fraction.

Embodiment 3-A

The cycloalkyl heavy oil catalytic feed and the feedback oil produce the catalytic hydrocarbon under the catalysis of LANET-35 catalyst produced by Lanzhou Catalyst Plant. The catalytic hydrocarbon is cycloalkyl catalytic cracking heavy oil. It is fractionated at the fractionator 1. The overhead temperature of the fractionator 1 is 80° C., the diesel fuel outlet temperature is 240° C., the bottom temperature is 370° C., the overhead pressure is 0.1 MPa, the bottom pressure is 0.12 MPa; two side cuts are added at the middle section of the fractionator 1 to draw the intermediate fraction. The two side cut temperature from up to down is 180, 190° C., the distillation range of the intermediate fraction is 80~165° C., 165~220° C. respectively. The intermediate fractions got from two distillation ranges are pumped to the two same extractor for solvent extraction. The solvent is N-formoxyl morphinone, the extraction temperature is 85° C., and extraction pressure is 0.4 MPa. Solvent weight ratio (solvent/feed) is 3.1. Aromatic and non-aromatic hydrocarbon fraction is separated; The aromatic hydrocarbon gofraction go to the middle section of fractionator 3 after combination for distillation, the distillation temperature is 120~180° C., and the distillation pressure is 0.04~0.20 MPa, stripping water will be feed in at the bottom, the overhead fraction is high octane number fraction, the lower side cut is heavy aromatic hydrocarbon fraction, the bottom cut is for the recycle solvent; All the high octane number fractions are blended with gasoline fraction; the non-aromatic hydrocarbon fraction go to the middle section of fractionator 4 after combination for distillation. The distillation temperature is 100~135° C., the pressure is 0.15~0.25 MPa, the overhead cut is light non-aromatic, the bottom cut is diesel fuel fraction; the diesel fuel fraction is blended with the diesel fuel fraction completely; Light non-aromatic taken as the light oil for chemical.

Embodiment 4-A

See FIG. 3-A, the paraffine-based catalytic feed and the feedback oil produce catalytic hydrocarbon under the catalysis of LBO-16 catalyst produced by Lanzhou Catalyst Plant, the catalytic hydrocarbon is cycloalkyl catalytic hydrocarbon heavy oil. It is fractionated at the fractionator 1. The overhead temperature of the fractionator 1 is 50° C., the diesel fuel outlet temperature is 210° C., the bottom temperature is 340° C., the overhead pressure is 0.1 MPa, and the bottom pressure is 0.12 MPa. The distillation range of the gasoline fraction is controlled at 35~120° C. The distillation range of the diesel fuel 1 fraction is controlled at 120~355° C. Diesel fuel 1 fraction is pumped to fractionator 2 for secondary distillation. The overhead temperature of the fractionator 2 is 80° C., the diesel fuel outlet temperature is 240° C., the bottom temperature is 370° C., the overhead pressure is 0.1 MPa, the bottom pressure is 0.12 MPa; an intermediate fraction with the distillation range of 80~240° C. is drawn from The overhead of fractionator 2. The bottom cut is the gasoline fraction with the distillation range of 240~380° C. The intermediate fraction is pumped to the extractor for solvent extraction. The solvent is N-methyl pyrrole alkane alkone, the extraction temperature is 66° C., and extraction pressure is 0.4 MPa. Solvent weight ratio (solvent/feed) is 3.3. Aromatic and non-aromatic hydrocarbon fraction is separated; The aromatic hydrocarbon gofraction go to the middle section of fractionator 3 for distillation, the distillation temperature is 120~180° C., and the distillation pressure is 0.04~0.20 MPa, stripping water is feed in at the bottom, the overhead fraction is high octane number fraction, the lower side cut is heavy aromatic hydrocarbon fraction, the bottom cut is used for recycle solvent; All the high octane number fractions are blended with gasoline fraction; the non-aromatic hydrocarbon fraction go to the fractionator 4 at the middle section for distillation. The distillation temperature is 100~135° C., the pressure is 0.15~0.25 MPa, the overhead cut is light non-aromatic, the bottom cut is diesel fuel fraction; All the diesel fuel fraction are blend with the diesel fuel fraction; Light non-aromatic is taken as the light oil for chemical.

Embodiment 5-A

See FIG. 2-A, the cycloalkyl heavy oil catalytic feed and the feedback oil produce the catalytic hydrocarbon under the catalysis of LANET-35 catalyst produced by Lanzhou Catalyst Plant. The catalytic hydrocarbon is cycloalkyl catalytic cracking heavy oil. It is fractionated at the fractionator 1. The overhead temperature of the fractionator 1 is 120° C., the diesel fuel outlet temperature is 270° C., the bottom temperature is 370° C., the overhead pressure is 0.1 MPa, the bottom pressure is 0.12 MPa; the distillation range of the gasoline fraction is controlled at 35~240° C. The distillation range of the diesel fuel 1 fraction is controlled at 240~385° C. Gasoline 1 fraction is pumped to fractionator 2 for secondary distillation. The overhead temperature of the fractionator 2 is 80° C., the diesel fuel outlet temperature is 240° C., the bottom temperature is 370° C., the overhead pressure is 0.1 MPa, the bottom pressure is 0.12 MPa; an intermediate fraction with the distillation range of 110~210° C. is drawn from the bottom of fractionator 2. The overhead is the gasoline fraction with the distillation range of 35~110° C. The intermediate fraction is pumped to the extractor for solvent extraction. The solvent is N-methyl pyrrole alkane alkone and 50% of tetraethylene glycol, the extraction temperature is 80° C., extraction pressure is 0.4 MPa. Solvent weight ratio (solvent/feed) is 3.3. Aromatic and non-aromatic hydrocarbon fraction is separated; The aromatic hydrocarbon gofraction go to the middle section of fractionator 3 for distillation, the distillation temperature is 120~180° C., and the distillation pressure is 0.04~0.20 MPa, stripping water is feed in at the bottom, the overhead fraction is high octane number fraction, the lower side cut is heavy aromatic hydrocarbon fraction, the bottom cut is used for recycle solvent; All the high octane number fractions are blended with gasoline fraction to make 93# gasoline; the non-aromatic hydrocarbon fraction go to the fractionator 4 at the middle section for distillation. The distillation temperature is 100~135° C., the pressure is 0.15~0.25 MPa, the overhead cut is light non-aromatic, the bottom cut is diesel fuel fraction; All the diesel fuel fractions are blended with the diesel fuel fraction to make 5# diesel fuel; Light non-aromatic is taken as the light oil for chemical.

Embodiment 6-A

The paraffine-based catalytic feed and the feedback oil produce catalytic hydrocarbon under the catalysis of LCS catalyst produced by Lanzhou Catalyst Plant, the catalytic hydrocarbon is catalytic cracking wax oil. It is fractionated at the fractionator 1. The overhead temperature of the fractionator 1 is 80° C., the diesel fuel outlet temperature is 240° C., the bottom temperature is 370° C., the overhead pressure is 0.1 MPa, and the bottom pressure is 0.12 MPa. One side cut is added at the middle section of fractionator 1 for FIG. out the intermediate fraction. The temperature of the side cut is 180° C. The distillation range of the intermediate fraction is 140~240° C. The intermediate fraction is pumped to the extractor for solvent extraction. The solvent is pentaethylene glycol. The extraction temperature is 100° C., extraction pressure is 0.4 MPa. Solvent weight ratio (solvent/feed) is 2.9. Aromatic and non-aromatic hydrocarbon fraction is separated; the aromatic hydrocarbon fraction is taken as the high quality gasoline directly is 0.04~0.20 MPa, the non-aromatic hydrocarbon fraction go to the fractionator 4 at the middle section for distillation. The distillation temperature is 100~150° C., the pressure is 0.15~0.25 MPa, the overhead cut is light non-aromatic fraction, the bottom cut is diesel fuel fraction; All the diesel fuel fractions are blended with the diesel fuel fraction; Light non-aromatic is taken as the light oil for chemical.

The yield and the properties of Comparison Embodiments and the Embodiments are shown as the following tables:

TABLE 1-A

Yield comparison of Comparison Embodiment 1-A and Embodiment 1-A

| Product distribution | Comparison Embodiment 1-A | Embodiment 1-A | Change |
|---|---|---|---|
| Dry gas, Weight % | 4.7 | 4.7 | 0 |
| Liquid gas, Weight % | 11.25 | 11.25 | 0 |
| Gasoline, Weight % | 39.09 | 29.38 | −9.71 |
| Diesel fuel, Weight % | 40.71 | 46.53 | 5.82 |
| Coke, Weight % | 3.99 | 3.99 | 0 |
| Oil slurry, Weight % | 0 | 0 | 0 |
| Chemical light oil, Weight % | 0 | 3.89 | 3.89 |
| Loss, Weight % | 0.3 | 0.3 | 0 |
| Yield of the light oil, Weight % | 75.99 | 75.99 | 0 |

TABLE 2-A

Yield of the Embodiment 2-A–4-A

| Product distribution | Embodiment 2-A | Embodiment 3-A | Embodiment 4-A |
|---|---|---|---|
| Dry gas, Weight % | 6 | 3.65 | 4.21 |
| Liquid gas, Weight % | 9.5 | 11.76 | 12.61 |

TABLE 2-A-continued

Yield of the Embodiment 2-A–4-A

| Product distribution | Embodiment 2-A | Embodiment 3-A | Embodiment 4-A |
|---|---|---|---|
| Gasoline, Weight % | 29.38 | 26.18 | 37.01 |
| Diesel fuel, Weight % | 28.57 | 44.56 | 29.68 |
| Coke, Weight % | 9 | 8.02 | 7.42 |
| Oil slurry, Weight % | 9 | 3.75 | 5.55 |
| Chemical light oil, Weight % | 6.55 | 1.89 | 3.17 |
| Heavy aromatic, Weight % | 0.8 | | |
| Loss, Weight % | 0.3 | 0.3 | 0 |

It is shown that the invention can improve the diesel fuel/gasoline ratio significantly, and also get the chemical light oil.

TABLE 3-A

Property comparison of Comparison Embodiment 1-A and Embodiment 1-A

| Product distribution | Comparison Embodiment 1-A | Embodiment 1-A | Change |
|---|---|---|---|
| Aromatic content in the gasoline, m % | 23.1 | 39.3 | 16.2 |
| Octane number of the gasoline | 90.2 | 93.9 | 3.7 |
| Gasoline density, kg/m$^3$ | 718 | 739 | 21 |
| Distillation range of gasoline, ° C. | 36~171 | 36~204 | — |
| Olefin content of the gasoline, % | 42.7 | 37.5 | 5.2 |
| Dry point of gasoline, ° C. | 171 | 204 | 33 |
| Aromatic content of the diesel fuel, m % | 48.2 | 39 | −9.2 |
| Cetane number of the diesel fuel | 38 | 43 | 5 |
| Diesel fuel density, kg/m$^3$ | 847 | 829 | −18 |
| Distillation range of diesel fuel, ° C. | 181~346 | 167~346 | — |
| Flash point of diesel fuel, ° C. | 71 | 57 | −14 |
| Distillation range of chemical light oil, ° C. | | 120~171 | — |
| Density of chemical light oil kg/m$^3$ | | 683 | — |
| Aromatic content of the chemical light oil, m % | | 2.1 | — |
| Olefin content of the chemical light oil, m % | | 23 | — |

TABLE 4-A

Property of the Embodiment 2-A–4-A

| Product distribution | Embodiment 2-A | Embodiment 3-A | Embodiment 4-A |
|---|---|---|---|
| Aromatic content in the gasoline, m % | 41 | 39 | 38.5 |
| Octane number of the gasoline | 94.2 | 92.3 | 93 |
| Gasoline density, kg/m$^3$ | 751 | 761 | 756 |
| Distillation range of gasoline, ° C. | 36~204 | 36~204 | 36~204- |
| Olefin content of the gasoline, % | 39.5 | 34 | 34.6 |
| Dry point of gasoline, ° C. | 204 | 204 | 204 |
| Aromatic content of the diesel fuel, m % | 40 | 40 | 39 |

TABLE 4-A-continued

| Property of the Embodiment 2-A–4-A | | | |
|---|---|---|---|
| Product distribution | Embodiment 2-A | Embodiment 3-A | Embodiment 4-A |
| Cetane number of the diesel fuel | 38 | 36 | 39 |
| Diesel fuel density, kg/m$^3$ | 854 | 852 | 852 |
| Distillation range of diesel fuel, ° C. | 165~346 | 165~346 | 165~346 |
| Flash point of diesel fuel, ° C. | 57 | 56 | 56 |
| Distillation range of chemical light oil, ° C. | 80~165 | 100~165 | 100~165 |
| Density of chemical light oil kg/m$^3$ | 667 | 682 | 682 |
| Aromatic content of the chemical light oil, m % | 2.6 | 2.9 | 2.9 |
| Olefin content of the chemical light oil, m % | 42 | 31 | 29 |
| Distillation range of heavy aromatic, ° C. | 80~171 | | |
| Density of the heavy aromatic, kg/m$^3$ | 845 | | |
| Aromatic content of heavy aromatic, m % | 98.2 | 23 | — |

The aromatic content of the diesel fuel was measured by GB11132-2002; the octane number of the gasoline was measured by GB/T5487; the density of the gasoline was measured by GB/T1884-1885; the distillation range of gasoline was measured by GB/T6536; the olefin content of gasoline was measured by GB11132-2002; the aromatic content of the diesel fuel was measured by GB11132-2002; Cetane number of the diesel fuel was measured by GB/T386. The density of diesel fuel was measured by GB/T1884-1885; the distillation range of diesel fuel was measured by GB/T6536; the flash point of diesel fuel was measured by GB/T261; the distillation range of chemical light oil was measured by GB/T6536; the density of chemical light oil was measured by GB/T1884-1885; the aromatic content of the chemical light oil was measured by GB11132-2002; the olefin content of chemical light oil was measured by GB11132-2002;

Tables 3-A and 4-A show that the invention can increase the octane number of gasoline, and the aromatic content also; the cetane number of diesel fuel also get improved; that means the quality of the gasoline and diesel fuel are improved.

Comparison Embodiment 1-B

The paraffine-based catalytic feed and the feedback oil produce catalytic hydrocarbon under the catalysis of LCS catalyst produced by Lanzhou Catalyst Plant. The catalytic hydrocarbon is fractionated at the fractionator 1. The overhead temperature of the fractionator 1 is 110° C., the diesel fuel outlet temperature is 190° C., the bottom temperature is 370° C., the overhead pressure is 0.11 MPa, and the bottom pressure is 0.12 MPa. The fractions are dry gas, liquid gas, gasoline, diesel fuel, heavy oil etc.

Embodiment 1-B

See FIG. 1-B, the paraffine-based catalytic feed and the feedback oil produce catalytic hydrocarbon under the catalysis of LCS catalyst produced by Lanzhou Catalyst Plant. The catalytic hydrocarbon is fractionated at the fractionator 1. The overhead temperature of the fractionator 1 is 80° C., the diesel fuel outlet temperature is 240° C., the bottom temperature is 370° C., the overhead pressure is 0.1 MPa, the bottom pressure is 0.12 MPa; One side cut is added at the middle section of the fractionator 1 to draw the intermediate fraction. The side cut temperature is 190° C., the distillation range of the intermediate fraction is 120~210° C. The intermediate fraction and the gasoline fraction are pumped to the extractor for solvent extraction, the solvent is sulfolane, the extraction temperature is 80° C., and extraction pressure is 0.4 MPa. Solvent weight ratio (solvent/feed) is 4.8. Aromatic and non-aromatic hydrocarbons are extracted; the aromatic hydrocarbon fraction and the solvent go to the middle section of fractionator 3 for distillation, the distillation temperature is 120~165° C., and the distillation pressure is 0.04~0.20 MPa, stripping water is feed in at the bottom, the overhead fraction is high octane number gasoline fraction, the lower side cut is heavy aromatic hydrocarbon fraction, the bottom cut is taken as the recycle solvent; the non-aromatic hydrocarbon fraction go to the fractionator 4 at the middle section for distillation. The distillation temperature is 100~135° C., the pressure is 0.15~0.25 MPa, overhead cut is light gasoline fraction, side cut is light non-aromatic hydrocarbon fraction; Bottom cut is diesel fuel fraction; All the diesel fuel fraction is blended with the diesel fuel fraction; 50% of the light non-aromatic is used as the chemical light oil; the rest 50% of non-aromatic is blended with all the high octane number gasoline fraction and light gasoline fraction.

Comparison Embodiment 2-B

The intermediate base atmosphere residual heavy oil catalytic feed and the feedback oil produce catalytic hydrocarbon under the catalysis of LANET-35 catalyst produced by Lanzhou Catalyst Plant. The catalytic hydrocarbon is fractionated at the fractionator 1. The overhead temperature of the fractionator 1 is 110° C., the diesel fuel outlet temperature is 190° C., the bottom temperature is 370° C., the overhead pressure is 0.11 MPa, and the bottom pressure is 0.12 MPa. The fractions are dry gas, liquid gas, gasoline, diesel fuel, heavy oil etc.

Embodiment 2-B

The intermediate base atmosphere residual heavy oil catalytic feed and the feedback oil produce the catalytic hydrocarbon under the catalysis of LANET-35 catalyst produced by Lanzhou Catalyst Plant. The catalytic hydrocarbon is fractionated at the fractionator 1. The overhead temperature of the fractionator 1 is 80° C., the diesel fuel outlet temperature is 240° C., the bottom temperature is 370° C., the overhead pressure is 0.1 MPa, the bottom pressure is 0.12 MPa; three side cuts are added at the middle section of the fractionator 1 to draw the intermediate fraction. The three side cut temperature from up to down is 170, 180, 190° C., the distillation range of the intermediate fraction is 80~120° C., 120~165° C., 165~220° C., the intermediate fraction got from the three distillation range and gasoline fraction is pumped to three same extractor for solvent extraction. The solvent is tetraethylene glycol, the extraction temperature is 85° C., and extraction pressure is 0.4 MPa. Solvent weight ratio (solvent/feed) is 3.1. Aromatic and non-aromatic hydrocarbons are extracted; The aromatic hydrocarbon gofraction go to the middle section of fractionator 3 after combination for distillation, the distillation temperature is 120~180° C., and the distillation pressure is 0.04~0.20 MPa, stripping water will be feed in at the bottom, the overhead fraction is high octane number gasoline fraction, the lower side cut is heavy aromatic hydrocarbon fraction, the bottom cut is taken as the recycle solvent; the non-aromatic hydrocarbon fraction go to the middle section of fractionator 4 after combination for distillation. The distillation temperature is 100~135° C., the pressure is 0.15~0.25 MPa, overhead cut is light gasoline fraction; Side cut is light non-aromatic hydrocarbon fraction; bottom cut is diesel fuel fraction; the diesel fuel fraction is taken as the feed for ethylene after hydro treating; Light non-aromatic is blended with the light gasoline fraction; All high octane number gasoline fraction is blended with the light gasoline fraction.

Comparison Embodiment 3-B

The cycloalkyl heavy oil catalytic feed and the feedback oil produce the catalytic hydrocarbon under the catalysis of LANET-35 catalyst produced by Lanzhou Catalyst Plant. The catalytic hydrocarbon is fractionated at fractionator 1, the overhead temperature of the fractionator 1 is 110° C., the diesel fuel outlet temperature is 190° C., the bottom temperature is 370° C., the overhead pressure is 0.11 MPa, and the bottom pressure is 0.12 MPa. The fractions are dry gas, liquid gas, gasoline, diesel fuel, heavy oil etc.

Embodiment 3-B

The cycloalkyl heavy oil catalytic feed and the feedback oil produce the catalytic hydrocarbon under the catalysis of LANET-35 catalyst produced by Lanzhou Catalyst Plant. The catalytic hydrocarbon is fractionated at the fractionator 1. The overhead temperature of the fractionator 1 is 80° C., the diesel fuel outlet temperature is 240° C., the bottom temperature is 370° C., the overhead pressure is 0.18 MPa, the bottom pressure is 0.25 MPa; two side cuts are added at the middle section of the fractionator 1 to draw the intermediate fraction. The two side cut temperature from up to lower section is 180, 190° C., the distillation range of the intermediate fraction is 80~165° C., 165~220° C. respectively. The intermediate fractions got from two distillation range are pumped to the two same extractor for solvent extraction after mixed with the gasoline fraction respectively. The solvent is N-formoxyl morphinone, the extraction temperature is 85° C., and extraction pressure is 0.4 MPa. Solvent weight ratio (solvent/feed) is 3.1. Aromatic and non-aromatic hydrocarbon fraction are extracted; The aromatic hydrocarbon gofraction go to the middle section of fractionator 3 after combination for distillation, the distillation temperature is 120~180° C., and the distillation pressure is 0.04~0.20 MPa, stripping water will be feed in at the bottom, the overhead fraction is high octane number fraction, the lower side cut is heavy aromatic hydrocarbon fraction, the bottom cut is for the recycle solvent; the non-aromatic hydrocarbon fraction go to the middle section of fractionator 4 after combination for distillation. The distillation temperature is 100~135° C., the pressure is 0.15~0.25 MPa, overhead cut is light gasoline; Side cut is light non-aromatic; bottom cut is diesel fuel fraction; the diesel fuel fraction is blended with the diesel fuel fraction completely; Light non-aromatic is taken as the light oil for chemical; High octane number gasoline fraction is blended with light gasoline; Heavy aromatic is blended with diesel fuel fraction.

Comparison Embodiment 4-B

50% of the paraffin base heavy oil and 50% of intermediate base heavy oil and the feedback oil produce the catalytic hydrocarbon under the catalysis of LANET-35 catalyst produced by Lanzhou Catalyst Plant. The catalytic hydrocarbon is fractionated at fractionator 1, the overhead temperature of the fractionator 1 is 110° C., the diesel fuel outlet temperature is 190° C., the bottom temperature is 370° C., the overhead pressure is 0.11 MPa, and the bottom pressure is 0.12 MPa. The fractions are dry gas, liquid gas, gasoline, diesel fuel, heavy oil etc.

Embodiment 4-B

See FIG. 2-B, the cycloalkyl heavy oil catalytic feed and the feedback oil produce the catalytic hydrocarbon under the catalysis of LANET-35 catalyst produced by Lanzhou Catalyst Plant. The catalytic hydrocarbon is fractionated at the fractionator 1. The overhead temperature of the fractionator 1 is 140° C., the diesel fuel outlet temperature is 220° C., the bottom temperature is 370° C., the overhead pressure is 0.1 MPa, the bottom pressure is 0.12 MPa; the distillation range of the gasoline fraction 1 is controlled at 35~240° C. The distillation range of the diesel fuel fraction is controlled at 240~385° C. Gasoline 1 fraction is pumped to fractionator 2 for secondary distillation. The overhead temperature of the fractionator 2 is 80° C., the intermediate fraction outlet temperature is 240° C., the bottom temperature is 370° C., the overhead pressure is 0.1 MPa, the bottom pressure is 0.12 MPa; an intermediate fraction with the distillation range of 110~210° C. is drawn from the bottom of fractionator 2. The overhead is the gasoline fraction with the distillation range of 35~110° C. The intermediate fraction and gasoline fraction is pumped to the extractor for solvent extraction. The solvent is 5% N-methyl pyrrole alkane alkone and 50% of tetraethylene glycol, the extraction temperature is 80° C., extraction pressure is 0.4 MPa. Solvent weight ratio (solvent/feed) is 3.3. Aromatic and non-aromatic hydrocarbon fraction extracted; the aromatic hydrocarbon fraction and the solvent go to the middle section of fractionator 3 for distillation, the distillation temperature is 120~180° C., and the distillation pressure is 0.04~0.20 MPa, stripping water is feed in at the bottom, the overhead fraction is high octane number gasoline fraction, the lower side cut is heavy aromatic hydrocarbon fraction, the bottom cut is used for recycle solvent; the non-aromatic hydrocarbon fraction go to the fractionator 4 at the middle section for distillation. The distillation temperature is 100~135° C., the pressure is 0.15~0.25 MPa, overhead cut is light gasoline fraction, side cut is light non-aromatic hydrocarbon fraction, the bottom cut is diesel fuel fraction; the high octane number gasoline is blended with light gasoline to make 93# gasoline; All the diesel fuel fractions are blended with the diesel fuel fraction to make 5# diesel fuel; Light non-aromatic is taken as the light oil for chemical.

Comparison Embodiment 5-B

The paraffin base heavy oil and feedback oil produce the catalytic hydrocarbon under the catalysis of LBO-16 catalyst produced by Lanzhou Catalyst Plant. The catalytic hydrocarbon is fractionated at fractionator 1, the overhead temperature of the fractionator 1 is 110° C., the diesel fuel outlet temperature is 190° C., the bottom temperature is 370° C., the overhead pressure is 0.11 MPa, and the bottom pressure is 0.12 MPa. The fractions are dry gas, liquid gas, gasoline, diesel fuel, heavy oil etc.

Embodiment 5-B

See FIG. 3-B, the paraffin base heavy oil catalytic feed and the feedback oil produce the catalytic hydrocarbon under the catalysis of LBO-16 catalyst produced by Lanzhou Catalyst Plant. The catalytic hydrocarbon is fractionated at the fractionator 1. The overhead temperature of the fractionator 1 is 90° C., the diesel fuel outlet temperature is 180° C., the bottom temperature is 340° C., the overhead pressure is 0.1 MPa, the bottom pressure is 0.12 MPa; the distillation range of the gasoline fraction is controlled at 35~120° C. The distillation range of the diesel fuel fraction 1 is controlled at 120~355° C. Gasoline 1 fraction is pumped to fractionator 5 for secondary distillation. The overhead temperature of the fractionator 5 is 80° C., the diesel fuel outlet temperature is 240° C., the bottom temperature is 370° C., the overhead pressure is 0.1 MPa, the bottom pressure is 0.12 MPa; the overhead of the fractionator 5 is the intermediate fraction with the distillation range of 80~240° C.; Bottom cut is the diesel fuel fraction with the distillation range of 240~380° C.; the intermediate fraction and gasoline fraction is pumped to the extractor for solvent extraction. The solvent is N-methyl pyrrole alkane alkone, the extraction temperature is 66° C., and extraction pressure is 0.4 MPa. Solvent weight ratio (solvent/feed) is 3.3. Aromatic and non-aromatic hydrocarbon fraction extracted; the aromatic hydrocarbon fraction and the solvent go to the middle section of fractionator 3 for distillation, the distillation temperature is 120~180° C., and the distillation pressure is 0.04~0.20 MPa, stripping water is feed in at the bottom, the overhead fraction is high octane number gasoline fraction, the lower side cut is heavy aromatic hydrocarbon fraction, the bottom cut is used for recycle solvent; the non-aromatic hydrocarbon fraction go to the fractionator 4 at the middle section for distillation. The distillation temperature is 100~150° C., the pressure is 0.15~0.25 MPa, overhead cut is light gasoline fraction, side cut is light non-aromatic hydrocarbon fraction, the bottom cut is diesel fuel fraction; the diesel fuel fraction is used as the feed for ethylene after hydro treating; the high octane number gasoline is blended with light gasoline; Light non-aromatic is taken as the light oil for chemical.

Comparison Embodiment 6-B

Residual mixing ratio 60 paraffin base heavy oil and the feedback oil produce the catalytic hydrocarbon under the catalysis of LANET-35 catalyst produced by Lanzhou Catalyst Plant. The catalytic hydrocarbon is fractionated at fractionator 1, the overhead temperature of the fractionator 1 is 110° C., the diesel fuel outlet temperature is 190° C., the bottom temperature is 370° C., the overhead pressure is 0.11 MPa, and the bottom pressure is 0.12 MPa. The fractions are dry gas, liquid gas, gasoline, diesel fuel, heavy oil etc.

Embodiment 6-B

Residual mixing ratio 60 paraffin base heavy oil and the feedback oil produce the catalytic hydrocarbon under the catalysis of LANET-35 catalyst produced by Lanzhou Catalyst Plant. The catalytic hydrocarbon is fractionated at the fractionator 1. The overhead temperature of the fractionator 1 is 80° C., the diesel fuel outlet temperature is 240° C., the bottom temperature is 370° C., the overhead pressure is 0.1 MPa, the bottom pressure is 0.12 MPa; One side cut is added at the middle section of fractionator 1 to get the intermediate fraction. The side cut temperature is 180° C. The distillation range of the intermediate fraction is at 140~240° C. The intermediate fraction and gasoline fraction is pumped to the extractor for solvent extraction. The solvent is pentaethylene glycol, the extraction temperature is 100° C., and extraction pressure is 0.4 MPa. Solvent weight ratio (solvent/feed) is 2.9. Aromatic and non-aromatic hydrocarbon fraction extracted; the aromatic hydrocarbon fraction is used as high quality gasoline directly. The non-aromatic hydrocarbon fraction go to the fractionator 4 from the middle section for distillation, the distillation temperature is 100~150° C., and the distillation pressure is 0.15~0.25 MPa, Overhead is light non-aromatic, the bottom cut is diesel fuel. All diesel fuel fractions are blended with the diesel fuel fraction; Light non-aromatic is taken as the light oil for chemical.

The yield and the properties of Comparison Embodiments and the Embodiments are shown as the following tables:

TABLE 1-B

Yield comparison of Comparison Embodiment 1-B and Embodiment 1-B

| Product distribution | Comparison Embodiment 1-B | Embodiment 1-B | Change |
|---|---|---|---|
| Dry gas, Weight % | 4.7 | 4.7 | 0 |
| Liquid gas, Weight % | 11.25 | 11.25 | 0 |
| Gasoline, Weight % | 39.09 | 31.32 | −8.58 |
| Diesel fuel, Weight % | 40.71 | 46.53 | 5.82 |
| Coke, Weight % | 3.99 | 3.99 | 0 |
| Oil slurry, Weight % | 0 | 0 | 0 |
| Chemical light oil, Weight % | 0 | 1.95 | 1.95 |
| Loss, Weight % | 0.3 | 0.3 | 0 |

TABLE 2-B

Property comparison of Comparison Embodiment 1-B and Embodiment 1-B

| Product distribution | Comparison Embodiment 1-B | Embodiment 1-B | Change |
|---|---|---|---|
| Aromatic content in the gasoline, m % | 23.1 | 36.1 | 13 |
| Octane number of the gasoline | 90.2 | 92.6 | 2.4 |
| Gasoline density, kg/m$^3$ | 718 | 732 | 14 |
| Distillation range of gasoline, ° C. | 36~171 | 36~204 | — |
| Olefin content of the gasoline, % | 42.7 | 38.9 | −3.8 |
| Dry point of gasoline, ° C. | 171 | 204 | 33 |
| Aromatic content of the diesel fuel, v % | 48.2 | 39 | −9.2 |
| Cetane number of the diesel fuel | 38 | 43 | 5 |
| Diesel fuel density, kg/m$^3$ | 847 | 829 | −18 |
| Distillation range of diesel fuel, ° C. | 181~346 | 167~346 | — |
| Flash point of diesel fuel, ° C. | 71 | 57 | −14 |
| Distillation range of chemical light oil, ° C. | | 120~171 | — |
| Density of chemical light oil kg/m$^3$ | | 683 | — |
| Aromatic content of the chemical light oil, v % | | 2.1 | — |
| Olefin content of the chemical light oil, v % | | 23 | — |

TABLE 3-B

Yield comparison of Comparison Embodiment 2-B and Embodiment 2-B

| Product distribution | Comparison Embodiment 1-B | Embodiment 1-B | Change |
|---|---|---|---|
| Dry gas, Weight % | 6 | 6 | 0 |
| Liquid gas, Weight % | 9.5 | 9.5 | 0 |
| Gasoline, Weight % | 41.5 | 35.93 | −5.57 |
| Diesel fuel, Weight % | 23 | 21.37 | −1.63 |
| Coke, Weight % | 9 | 9 | 0 |
| Oil slurry, Weight % | 9 | 9 | 0 |
| Diesel fuel fraction, Weight % | 0 | 8.1 | 8.1 |
| Chemical light oil, Weight % | 0 | 0.8 | 0.8 |
| Loss, Weight % | 2 | 0.3 | 0 |

TABLE 4-B

Property comparison of Comparison Embodiment 2-B and Embodiment 2-B

| Product distribution | Comparison Embodiment 2-B | Embodiment 2-B | Change |
|---|---|---|---|
| Aromatic content in the gasoline, v % | 29 | 38 | 9 |
| Octane number of the gasoline | 91 | 93.1 | 2.1 |
| Gasoline density, kg/m$^3$ | 738 | 749 | 11 |
| Distillation range of gasoline, ° C. | 35~182 | 36~204 | — |
| Olefin content of the gasoline, v % | 58 | 42.3 | −15.7 |
| Dry point of gasoline, ° C. | 182 | 203 | 32 |
| Aromatic content of the diesel fuel, v % | 56 | 57 | 1 |
| Octane number of the diesel fuel | 30 | 29.5 | −0.5 |
| Diesel fuel density, kg/m$^3$ | 886 | 889 | 3 |
| Distillation range of diesel fuel, ° C. | 182~352 | 203~346 | — |
| Flash point of diesel fuel, ° C. | 75 | 76 | 1 |
| Distillation range of diesel fuel fraction, ° C. | | 165~205 | — |
| Density of diesel fuel fraction kg/m$^3$ | | 789 | — |
| Distillation range of heavy aromatic, ° C. | | 80~171 | — |
| Density of the heavy aromatic, kg/m$^3$ | | 845 | — |
| Aromatic content of heavy aromatic, m % | | 98.2 | — |

TABLE 5-B

Yield comparison of Comparison Embodiment 3-B and Embodiment 3-B

| Product distribution | Comparison Embodiment 3-B | Embodiment 3-B | Change |
|---|---|---|---|
| Dry gas, m % | 3.65 | 3.65 | 0 |
| Liquid gas, m % | 11.76 | 11.76 | 0 |
| Gasoline, m % | 35.98 | 28.27 | −7.71 |
| Diesel fuel, m % | 36.65 | 44.36 | 7.71 |
| Coke, m % | 8.02 | 8.02 | 0 |
| Oil slurry, m % | 3.75 | 3.75 | 0 |
| Loss, m % | 0.24 | 0.3 | 0 |

TABLE 6-B

Property comparison of Comparison Embodiment 3-B and Embodiment 3-B

| Product distribution | Comparison Embodiment 3-B | Embodiment 3-B | Change |
|---|---|---|---|
| Aromatic content in the gasoline, v % | 21 | 36.9 | 15.9 |
| Octane number of the gasoline | 89 | 92 | 3 |
| Gasoline density, kg/m$^3$ | 723 | 735 | 12 |
| Distillation range of gasoline, ° C. | 35~203 | 36~204 | — |
| Olefin content of the gasoline, v % | 29 | 36 | 7 |
| Dry point of gasoline,° C. | 203 | 204 | 1 |
| Aromatic content of the diesel fuel, v % | 51 | 40 | −11 |
| Cetane number of the diesel fuel | 29 | 35 | 6 |
| Diesel fuel density, kg/m$^3$ | 887 | 852 | −35 |
| Distillation range of diesel fuel, ° C. | 203~349 | 165~346 | — |
| Flash point of diesel fuel, ° C. | 85 | 56 | −29 |

TABLE 7-B

Yield comparison of Comparison Embodiment 4-B and Embodiment 4-B

| Product distribution | Comparison Embodiment 4-B | Embodiment 4-B | Change |
|---|---|---|---|
| Dry gas, m % | 6.2 | 6.2 | 0 |
| Liquid gas, m % | 29.1 | 29.1 | 0 |
| Gasoline, m % | 45.6 | 33.5 | −12.1 |
| Diesel fuel, m % | 16.3 | 21.7 | 5.4 |
| Coke, m % | 8.1 | 8.1 | 0 |
| Oil slurry, m % | 0.2 | 0.2 | 0 |
| Chemical light oil, m % | 0 | 6.7 | 6.7 |
| Loss, m % | 0.5 | 0.5 | 0 |

TABLE 8-B

Property comparison of Comparison Embodiment 4-B and Embodiment 4-B

| Product distribution | Comparison Embodiment 4-B | Embodiment 4-B | Change |
|---|---|---|---|
| Aromatic content in the gasoline, v % | 33 | 38.5 | 19.5 |
| Octane number of the gasoline | 92.3 | 97 | 4.7 |
| Gasoline density, kg/m$^3$ | 741 | 756 | 22 |
| Distillation range of gasoline, ° C. | 35~192 | 35~204 | — |
| Olefin content of the gasoline, v % | 59 | 51 | −8 |
| Dry point of gasoline, ° C. | 190 | 204 | 14 |
| Aromatic content of the diesel fuel, v % | 52 | 39 | −13 |
| Cetane number of the diesel fuel | 32 | 39 | 7 |
| Diesel fuel density, kg/m$^3$ | 887 | 852 | −35 |
| Distillation range of diesel fuel, ° C. | 203~363 | 165~363 | — |

TABLE 8-B-continued

Property comparison of Comparison Embodiment 4-B and Embodiment 4-B

| Product distribution | Comparison Embodiment 4-B | Embodiment 4-B | Change |
|---|---|---|---|
| Flash point of diesel fuel, ° C. | 75 | 56 | −19 |
| Distillation range of chemical light oil, ° C. | — | 100~165 | — |
| Density of chemical light oil kg/m$^3$ | — | 682 | — |
| Aromatic content of the chemical light oil, v % | — | 2.9 | — |
| Olefin content of the chemical light oil, v % | — | 58 | — |

TABLE 9-B

Yield comparison of Comparison Embodiment 5-B and Embodiment 5-B

| Product distribution | Comparison Embodiment 5-B | Embodiment 5-B | Change |
|---|---|---|---|
| Dry gas, m % | 4.21 | 4.21 | 0 |
| Liquid gas, m % | 12.61 | 12.61 | 0 |
| Gasoline, m % | 47.04 | 37.02 | −10.02 |
| Diesel fuel, m % | 22.82 | 29.67 | 6.85 |
| Coke, m % | 7.42 | 7.42 | 0 |
| Oil slurry, m % | 5.55 | 5.55 | 0 |
| Chemical light oil, m % | 0 | 3.17 | 3.17 |
| Loss, m % | 0.35 | 0.35 | 0 |

TABLE 10-B

Property comparison of Comparison Embodiment 5-B and Embodiment 5-B

| Product distribution | Comparison Embodiment 5-B | Embodiment 5-B | Change |
|---|---|---|---|
| Aromatic content in the gasoline, v % | 19 | 38.5 | 19.5 |
| Octane number of the gasoline | 89 | 93 | 4 |
| Gasoline density, kg/m$^3$ | 734 | 756 | 22 |
| Distillation range of gasoline, ° C. | 35~190 | 36~204 | — |
| Olefin content of the gasoline, v % | 33.33 | 34.6 | 1.27 |
| Dry point of gasoline, ° C. | 190 | 204 | 14 |
| Aromatic content of the diesel fuel, v % | 52 | 39 | −13 |
| Cetane number of the diesel fuel | 32 | 39 | 7 |
| Diesel fuel density, kg/m$^3$ | 887 | 852 | −35 |
| Distillation range of diesel fuel, ° C. | 203~363 | 165~363 | — |
| Flash point of diesel fuel, ° C. | 75 | 56 | −19 |
| Distillation range of chemical light oil, ° C. | | 100~165 | — |
| Density of chemical light oil kg/m$^3$ | | 682 | — |
| Aromatic content of the chemical light oil, v % | | 2.9 | — |
| Olefin content of the chemical light oil, v % | | 29 | — |

TABLE 11-B

Yield comparison of Comparison Embodiment 6-B and Embodiment 6-B

| Product distribution | Comparison Embodiment 6-B | Embodiment 6-B | Change |
|---|---|---|---|
| Dry gas, m % | 10.2 | 10.2 | 0 |
| Liquid gas, m % | 38.9 | 38.9 | 0 |
| Gasoline, m % | 32.5 | 25.2 | −7.3 |
| Diesel fuel, m % | 10.4 | 14.2 | 3.8 |
| Coke, m % | 7.9 | 7.9 | 0 |
| Oil slurry, m % | 0.2 | 0.2 | 0 |
| Heavy aromatic hydrocarbon fraction, m % | 0 | 3.5 | 3.5 |
| Loss, m % | 0.3 | 0.3 | 0 |

TABLE 12-B

Property comparison of Comparison Embodiment 6-B and Embodiment 6-B

| Product distribution | Comparison Embodiment 6-B | Embodiment 6-B | Change |
|---|---|---|---|
| Aromatic content in the gasoline, v % | 36 | 41.1 | 5.1 |
| Octane number of the gasoline | 92.7 | 93.9 | 1.2 |
| Gasoline density, kg/m$^3$ | 748 | 762 | 14 |
| Distillation range of gasoline, ° C. | 35~195 | 35~204 | — |
| Olefin content of the gasoline, m % | 56 | 58 | −2 |
| Dry point of gasoline, ° C. | 195 | 204 | 9 |
| Aromatic content of the diesel fuel, v % | 56 | 41 | −15 |
| Cetane number of the diesel fuel | 26 | 34 | 8 |
| Diesel fuel density, kg/m$^3$ | 891 | 860 | −31 |
| Distillation range of diesel fuel, ° C. | 203~356 | 165~356 | — |
| Flash point of diesel fuel, ° C. | 81 | 56 | −25 |
| Distillation range of heavy aromatic hydrocarbon fraction, ° C. | | 204~240 | — |
| Density of heavy aromatic hydrocarbon fraction kg/m$^3$ | | 849 | — |
| Olefin content of the heavy aromatic hydrocarbon fraction, m % | | 97.9 | — |

The aromatic content of the diesel fuel was measured by GB11132-2002; the octane number of the gasoline was measured by GB/T5487; the density of the gasoline was measured by GB/T1884-1885; the distillation range of gasoline was measured by GB/T6536; the olefin content of gasoline was measured by GB11132-2002; the olefin content of diesel fuel was measured by GB11132-2002; Cetane number of the diesel fuel was measured by GB/T386. The density of diesel fuel was measured by GB/T1884-1885; the distillation range of diesel fuel was measured by GB/T6536; the flash point of diesel fuel was measured by GB/T261; the distillation range of chemical light oil (light non-aromatic) was measured by GB/T6536; the density of chemical light oil was measured by GB/T1884-1885; the aromatic content of the chemical light oil was measured by GB11132-2002; the olefin content of chemical light oil was measured by GB11132-2002;

Comparison Embodiment 1-C

The paraffine-based catalytic feed and the feedback oil produce catalytic hydrocarbon under the catalysis of LCS catalyst produced by Lanzhou Catalyst Plant. The catalytic hydrocarbon is catalytic cracking wax oil. It is fractionated at the fractionator. The overhead temperature of the fractionator is 80° C., the diesel fuel outlet temperature is 240° C., the bottom temperature is 370° C., the overhead pressure is 0.1 MPa, and the bottom pressure is 0.12 MPa. One side cut is added at the middle section of the fractionator to draw the intermediate fraction. The side cut temperature is 190° C., the distillation range of the intermediate fraction is 120~210° C. The intermediate fraction is pumped to plate tower for water wash then pumped to the extractor for solvent extraction. The solvent is sulfolane, the extraction temperature is 80° C., and extraction pressure is 0.4 MPa. Solvent weight ratio (solvent/feed) is 4.8. Sulfolane is regenerated by stripping. Aromatic and non-aromatic hydrocarbons are extracted; The aromatic hydrocarbon gofraction go to another fractionator for distillation, the distillation temperature is 120~165° C., and the distillation pressure is 0.04~0.20 MPa, stripping water is feed in at the bottom, the overhead fraction is high octane number fraction, the lower side cut is heavy aromatic hydrocarbon fraction, the bottom cut is taken as the recycle solvent; High octane number fraction fully blended with gasoline fraction. Non-aromatic hydrocarbon fraction goes to next fractionator from the middle section for distillation. The distillation temperature is 100~135° C., and the distillation pressure is 0.15~0.25 MPa. Overhead fraction is light non-aromatic hydrocarbon fraction, the bottom cut is diesel fuel fraction; All diesel fuel fraction is blended with the diesel fuel fraction; the light non-aromatic is blended with gasoline fraction.

Embodiment 1-C

See FIG. 1-C, the paraffine-based catalytic feed and the feedback oil produce catalytic hydrocarbon under the catalysis of LCS catalyst produced by Lanzhou Catalyst Plant. The catalytic hydrocarbon is catalytic cracking wax oil. It is fractionated at the fractionator. The overhead temperature of the fractionator is 80° C., the diesel fuel outlet temperature is 240° C., the bottom temperature is 370° C., the overhead pressure is 0.1 MPa, and the bottom pressure is 0.12 MPa. One side cut is added at the middle section of the fractionator to draw the intermediate fraction. The side cut temperature is 190° C., the distillation range of the intermediate fraction is 120~210° C. The intermediate fraction is pumped to plate tower for water wash then pumped to the extractor for solvent extraction. The solvent is sulfolane, the extraction temperature is 80° C., and extraction pressure is 0.4 MPa. Solvent weight ratio (solvent/feed) is 4.8. Aromatic and non-aromatic hydrocarbons are extracted; The aromatic hydrocarbon gofraction go to another fractionator from the middle section for distillation, the distillation temperature is 120~180° C., and the distillation pressure is 0.04~0.20 MPa, stripping water is feed in at the bottom, the overhead fraction is high octane number fraction, the lower side cut is heavy aromatic hydrocarbon fraction, the bottom cut is taken as the recycle solvent; High octane number fraction fully blended with gasoline fraction to make 93# gasoline. Non-aromatic hydrocarbon fraction goes to next fractionator from the middle section for distillation. The distillation temperature is 100~135° C., and the distillation pressure is 0.15~0.25 MPa. Overhead fraction is light non-aromatic hydrocarbon fraction, the bottom cut is diesel fuel fraction; All the diesel fuel fraction is blended with the diesel fuel fraction to make 5# diesel fuel; the light non-aromatic is taken as the chemical light oil.

The aromatic extraction solvent sulfolane is mixed with cooling water at Mixer 1, the weight ratio of the water and the sulfolane is 5.0, the stream go to the settlement area 3 of the solvent regenerator 2 after mixed, the lower section of settlement area 3 has one partition plate 32, the operation temperature of the settlement area 3 is 30° C., the pressure is 0.3 MPa, 3 layers is formed at the settlement area, the top layer is oil which is drained via an outlet, the lower layer is insoluble substance which will be discharged via a slag outlet, the middle layer is mixture of the water-soluble solvent and water, it will go to the stage 1 filtration area 4 via piping 31; the settlement area 3 and the stage 1 filtration area is isolated by the partition plate 32; the lower section of filtration area 4 equipped with partition plate 42 and 43, the filter element 41 is installed at partition plate 42, the filter element packed with multi-hole metal mesh, the diameter of the mesh holes is 50 μm, operating temperature is 40° C., the pressure is 0.2 MPa; the stream after treated at filtration area 4 go to stage 2 filtration area 5, the lower section of the filtration area 5 have 52 and 53 partition plate, the filter element is installed at the 52 filter element, the 51 filter element packed with multi-hole metal mesh, the diameter of the mesh holes is 20 μm, operating temperature is 40° C., the pressure is 0.1 MPa; the stream will go to distillation area 6 after treated at filtration area 5 to separate the sulfolane and water vapor and liquid, 61 tray is equipped at the top section of distillation area 6, reboiler 62 is at the bottom, the top temperature of distillation area 6 is 85° C., the bottom temperature of distillation area 6 is 150° C., the reboiler temperature is 200° C., the pressure of the distillation area is 0.08 MPa, water vapor goes to the condenser 7 cool down, then go to recover water tank 8 for oil and water separation, the water will go to mixer 1; Regenerated solvent will be discharged from the bottom of distillation area. The regenerated solvent and the analysis result of the solvent property are shown in table 1-C.

TABLE 1-C

| | Solvent | Regenerated solvent | Analysis method |
|---|---|---|---|
| Viscosity, 30° C., centipoises | 20.5 | 11.8 | GB/T265 |
| Color, | >5 | 2 | Colorimetry |
| PH | 5.8 | 6.1 | — |
| Water content in the solvent, ppm | 6500 | 6500 | n-butyl alcohol azeotropy |
| Hydrocarbon content in the solvent, ppm | 2000 | 100 | SY2128 |
| Appearance | brown | Light yellow | — |
| Continue operation time, year | — | 1 | — |
| Change of the feed rate, m % | — | ±5 | — |

Embodiment 2-C

See FIG. 2-C, the cycloalkyl heavy oil catalytic feed and the feedback oil produce the catalytic hydrocarbon under the catalysis of LANET-35 catalyst produced by Lanzhou Catalyst Plant. The catalytic hydrocarbon is cycloalkyl catalytic cracking heavy oil. It is fractionated at the fractionator. The overhead temperature of the fractionator is 120° C., the diesel fuel outlet temperature is 270° C., the bottom temperature is 370° C., the overhead pressure is 0.1 MPa, the bottom pressure is 0.12 MPa; the distillation range of the gasoline fraction 1 is controlled at 35~240° C. The distillation range of the diesel fuel fraction is controlled at 240~385° C. Gasoline 1 fraction is pumped to another fractionator for secondary distillation. The overhead temperature of the fractionator is 80° C., the diesel fuel outlet temperature is 240° C., the bottom temperature is 370° C., the overhead pressure is 0.1 MPa, the bottom pressure is 0.12 MPa; an intermediate fraction with the distillation range of 110~210° C. is drawn from the bottom of fractionator. The overhead is the gasoline fraction with the distillation range of 35~110° C. The intermediate fraction is in solvent extraction. The solvent is 50% N-methyl pyrrole alkane alkone and 50% of tetraethylene glycol, the extraction temperature is 80° C., extraction pressure is 0.4 MPa. Solvent weight ratio (solvent/feed) is 3.3. Aromatic and non-aromatic hydrocarbon fractions are extracted; The aromatic hydrocarbon gofraction go to the middle section of the another fractionator for distillation, the distillation temperature is 120~180° C., and the distillation pressure is 0.04~0.20 MPa, stripping water is feed in at the bottom, the overhead fraction is high octane number fraction, the lower side cut is heavy aromatic hydrocarbon fraction, the bottom cut is used for recycle solvent; the high octane number fraction is blended with gasoline fraction to make 93# gasoline; the non-aromatic hydrocarbon fraction go to the middle section of the last fractionator for distillation. The distillation temperature is 100~135° C., the pressure is 0.15~0.25 MPa, the overhead cut is light non-aromatic fraction, the bottom cut is diesel fuel fraction; the diesel fuel fraction is blended with the diesel fuel fraction to make 5# diesel fuel; Light non-aromatic is taken as the light oil for chemical.

It is the same as Embodiment 1-C, except in that: the water-soluble solvent is aromatic extraction solvent tetraethylene glycol; the weight ratio of the water and the tetraethylene glycol is 0.2; Valve V1, V2, V3 are set in between the settlement area 3, filtration area 4 and 5, the filter off material at the settlement area 3 can be discharged to filtration area 5; Valve V4, V5, V6, V7 are set in between filtration area 4, filtration area 5 and distillation area 6, the filter off material at settlement area 3 or filtration area 4 or 5 is discharged to distillation area 6 directly, in addition, V8, V9 are set, the filter off material at settlement area 3 or filtration area 4 or 5 or distillation area 6 is discharged directly, get regenerated solvent; V10 is set between mixer 1 and water recover tank 8; When filter off material does not go through distillation 6, V10 closed; When V2, V5, V8 closed, while the rest valve open, filter off material pass settlement area 3, filtration area 4, 5 and distillation area 6. The regenerated solvent and the analysis result of the solvent property is shown in table 2-C.

TABLE 2-C

| | Solvent | Regenerated solvent | Analysis method |
|---|---|---|---|
| Viscosity, 30° C., centipoises | 32.5 | 28.6 | GB/T265 |
| Color, | >5 | 2 | Colorimetry |
| PH | 7.2 | 7.5 | — |
| Water content in the solvent, ppm | 5 | 5 | n-butyl alcohol azeotropy |
| Hydrocarbon content in the solvent, ppm | 1500 | 1100 | SY2128 |
| Appearance | brown | Light yellow | — |
| Continue operation time, year | — | 1 | — |
| Change rate of the feed, m % | — | ±5 | — |

Embodiment 3-C

See FIG. 3-C, the paraffin base heavy oil catalytic feed and the feedback oil produce the catalytic hydrocarbon under the catalysis of LBO-16 catalyst produced by Lanzhou Catalyst Plant. The catalytic hydrocarbon is cycloalkyl catalytic cracking heavy oil. It is fractionated at the fractionator. The overhead temperature of the fractionator is 50° C., the diesel fuel outlet temperature is 210° C., the bottom temperature is 340° C., the overhead pressure is 0.1 MPa, the bottom pressure is 0.12 MPa; the distillation range of the gasoline fraction is controlled at 35~120° C. The distillation range of the diesel fuel fraction 1 is controlled at 120~355° C. Gasoline 1 fraction is pumped to another fractionator for secondary distillation. The overhead temperature of the fractionator is 80° C., the diesel fuel outlet temperature is 240° C., the bottom temperature is 370° C., the overhead pressure is 0.1 MPa, the bottom pressure is 0.12 MPa; an intermediate fraction with the distillation range of 80~240° C. is drawn from the overhead of fractionator. The bottom is the gasoline fraction with the distillation range of 240~380° C. The intermediate fraction goes to the extractor for solvent extraction. The solvent is N-methyl pyrrole alkane alkone, the extraction temperature is 66° C., and extraction pressure is 0.4 MPa. Solvent weight ratio (solvent/feed) is 3.3. Aromatic and non-aromatic hydrocarbon fractions are extracted; The aromatic hydrocarbon gofraction go to the middle section of the next fractionator for distillation, the distillation temperature is 120~180° C., and the distillation pressure is 0.04~0.20 MPa, stripping water is feed in at the bottom, the overhead fraction is high octane number fraction, the lower side cut is heavy aromatic hydrocarbon fraction, the bottom cut is used for recycle solvent; the high octane number fraction is blended with gasoline fraction completely; the non-aromatic hydrocarbon fraction go to the middle section of the last fractionator for distillation. The distillation temperature is 100~150° C., the pressure is 0.15~0.25 MPa, the overhead cut is light non-aromatic fraction, the bottom cut is diesel fuel fraction; the diesel fuel fraction is blended with the diesel fuel fraction completely; Light non-aromatic is taken as the light oil for chemical.

It is the same as Embodiment 1-C, except in that: the solvent N-methyl pyrrole alkane alkone is for aromatic extraction distillation. Filtration 4 and 5 is deleted; the weight ratio of the water and the solvent is 9.0. The regenerated solvent and the analysis result of the solvent property is shown in table 3-C.

TABLE 3-C

| | Solvent | Regenerated solvent | Analysis method |
|---|---|---|---|
| Viscosity, 30° C., centipoises | 2.3 | 0.9 | GB/T265 |
| Color, | >5 | 2 | Colorimetry |
| PH | 7.1 | 7.3 | — |
| Water content in the solvent, ppm | 3 | 3 | n-butyl alcohol azeotropy |
| Hydrocarbon content in the solvent, ppm | 2100 | 5 | SY2128 |
| Appearance | brown | Light yellow | — |
| Continue operation time, year | — | 1 | — |
| Change rate of the feed, m % | — | ±5 | — |

Embodiment 4-C

See FIG. 4-C, the paraffin base heavy oil catalytic feed and the feedback oil produce the catalytic hydrocarbon under the catalysis of LCS catalyst produced by Lanzhou Catalyst Plant. The catalytic hydrocarbon is catalytic cracking heavy oil. It is fractionated at the fractionator. The overhead temperature of the fractionator is 80° C., the diesel fuel outlet temperature is 240° C., the bottom temperature is 370° C., the overhead pressure is 0.1 MPa, the bottom pressure is 0.12 MPa; One side cut is added at the middle section of the fractionator to draw the intermediate fraction, the side cut temperature is 190° C., the distillation range of the intermediate fraction at 120~210° C. The intermediate fraction is pumped to the extractor for solvent extraction. The solvent is sulfolane, the extraction temperature is 80° C., and extraction pressure is 0.4 MPa. Solvent weight ratio (solvent/feed) is 4.8. Aromatic and non-aromatic hydrocarbon fractions are extracted; The aromatic hydrocarbon gofraction go to the middle section of another fractionator for distillation, the distillation temperature is 120~165° C., and the distillation pressure is 0.04~0.20 MPa, stripping water is feed in at the bottom, the overhead fraction is high octane number fraction, the lower side cut is heavy aromatic hydrocarbon fraction, the bottom cut is used for recycle solvent; the high octane number fraction is blended with gasoline fraction completely; the non-aromatic hydrocarbon fraction go to the middle section of the next fractionator for distillation. The distillation temperature is 100~135° C., the pressure is 0.15~0.25 MPa, the overhead cut is light non-aromatic fraction, the bottom cut is diesel fuel fraction; the diesel fuel fraction is blended with the diesel fuel fraction completely; Light non-aromatic is taken as the light oil for chemical.

The solvent N-formoxyl morpholine for aromatic extraction distillation is mixed with cooling water at Mixer 1, the weight ratio of the water and the N-formoxyl morpholine is 2.0, the stream go to the settler 9 after mixed, the operation temperature of the settler 9 is 90° C., the pressure is 1.0 MPa, 3 layers is formed at the settler, the top layer is oil which is drained via an outlet, the lower layer is insoluble substance which will be discharged via a slag outlet, the middle layer is mixture of the water-soluble solvent and water, it will go to the stage 1 filter 10; the bottom of the filer 10 is isolated by the partition plate 42; the filter element 41 is installed at partition plate 42, the filter element packed with ceramic elements, the diameter of the ceramic element holes is 40 μm, operating temperature is 50° C., the pressure is 0.9 MPa; the stream after treated at filter 10 go to stage 2 filter 11, the bottom of the filter 11 set one partition plate 52, the filter element 51 is installed at the 52, the 51 filter element packed with multi-hole metal powder metallurgy material, the diameter of the multi-hole metal powder metallurgy holes is 20 μm, operating temperature is 50° C., the pressure is 0.8 MPa; the stream will go to distillatory 12 after treated at filter 11 to separate vapor and liquid, tray 61 is equipped at the top section of distillatory 12, reboiler 62 is at the bottom, the top temperature of distillatory 12 is 85° C., the bottom temperature is 162° C., the reboiler temperature is 200° C., the pressure of the distillatory 12 is 0.08 MPa, water vapor goes to the condenser 7 cool down, then go to recover water tank 8 for oil and water separation, the water will go to mixer 1; Regenerated solvent will be discharged from the bottom of distillatory 12. The regenerated solvent and the analysis result of the solvent property is shown in table 4-C.

TABLE 4-C

| | Solvent | Regenerated solvent | Analysis method |
|---|---|---|---|
| Viscosity, 30° C., centipoises | 15.7 | 6.9 | GB/T265 |
| Color, | >5 | 2 | Colorimetry |
| PH | 7.6 | 7.8 | — |
| Water content in the solvent, ppm | 2 | 2 | n-butyl alcohol azeotropy |
| Hydrocarbon content in the solvent, ppm | 1000 | 40 | SY2128 |
| Appearance | brown | Light yellow | — |
| Continue operation time, year | — | 1 | — |
| Change rate of the feed, m % | — | ±5 | — |

Embodiment 5-C

See table 5-C, It is the same as Embodiment 1-C, except in that: the solvent is dimethylsulfoxide used during the absorption; the weight ratio of the water and the dimethylsulfoxide is 1.0; Valve V1, V2, V3, V4, V5, V6 are set in between the settlement area 3, filtration area 4 and 5, if close V2, V5, other valves are open, the water-soluble solvent at the settlement area 3 mixed with water and pass the filtration area 4 and 5, the regenerated solvent is discharged at the outlet of the filtration 5 directly; If close V2 only, other valves are open, the water-soluble solvent at the settlement area 3 mixed with water and must pass the filtration area 4, or pass filtration area 5, or get regenerated solvent at the outlet of filtration area 4 directly; If V2, V5 are fully closed, the regenerated solvent and the analysis result of the solvent property is shown in table 5-C.

TABLE 5-C

| | Solvent | Regenerated solvent | Analysis method |
|---|---|---|---|
| Viscosity, 30° C., centipoises | 2.3 | 0.9 | GB/T265 |
| Color, | >5 | 2 | Colorimetry |
| PH | 7.2 | 7.5 | — |
| Water content in the solvent, ppm | 5 | 5 | n-butyl alcohol azeotropy |
| Hydrocarbon content in the solvent, ppm | 2000 | 130 | SY2128 |
| Appearance | brown | Light yellow | — |
| Continue operation time, year | — | 1 | — |
| Change rate of the feed, m % | — | ±5 | — |

INDUSTRY APPLICATION

The advantages of the invention are: the products produced by the invention are from the gasoline and diesel fuel of the catalytic cracking fractionator, without other blended compositions; the yield of the gasoline is reduced; the aromatic content in the gasoline is increased, the octane number of the gasoline increased by 3-5 units; the distillation range of gasoline is extended from 35~190° C. to 35~203° C.; the yield of diesel fuel is increased by 5-7 units; the diesel fuel and gasoline ratio is increased by 0.4-0.8; the aromatic content of the diesel fuel is reduced, so as to increase the cetane number by 5-7 units; the distillation range of diesel fuel is extended from 180~365° C. to 165~365° C.; the flash point of the diesel fuel is reduced from 75° C. to 56° C.; the high quality light oil products and heavy aromatic products is increased; since the aromatic and non-aromatic hydrocarbons of the intermediate fraction of gasoline and diesel fuel are extracted, high octane number aromatic hydrocarbon fraction can be blended with gasoline fraction, making different proportion of 90#, 93#, 97# gasoline, so plants can adjust the operation scheme based on the market demand; According to the present invention, the catalytic gasoline can go to the market directly without blending with the high octane number fraction, thus saving the high octane number fraction, especial recombination oil, which is the main source of the light aromatic; compare with other process, with only one additional extractor and several fractionators on the basis of the existing catalytic hydrocarbon unit, the invention can not only increase the quality of gasoline and diesel fuel, but also produce different grades of gasoline and diesel fuel, lower capital cost, shorten construction schedule, easy operation, lower operation cost, and improve the diesel fuel and gasoline ratio which does not meet the demand in a short time.

In compare with the present regeneration system, the filtration system may be fouled due to the contaminant and gum, so cleaning is required frequently, and the quality of the regenerated solvent is poor; while the regeneration process of the invention undergoes settlement before filtration, the contaminants in the solvent is separated, and the gum in the solvent is separated effectively through filtration, so better solvent quality can be achieved after regeneration.

What is claimed is:

1. A process for producing fractions from a catalytic hydrocarbon, in which catalytic hydrocarbon feed is fractionated in one or more stages to produce a gasoline fraction, a diesel fraction and an intermediate fraction, the gasoline fraction boiling at 35 to 110° C.±30° C., the diesel fuel fraction boiling at 210±30° C.-355±30° C., and the intermediate fraction boiling at 120±30° C.-210±30° C. and the intermediate fraction, optionally after recombination with part or all of the gasoline fraction, is subsequently extracted at a solvent extractor to separate an aromatic fraction and a non-aromatic fraction, said fractionation being carried out by either use of a single fractionator from which three separate products, the gasoline fraction, the intermediate fraction and the diesel fraction are taken or by use of two fractionators, the first fractionator separating the feed into either a gasoline fraction and a higher boiling fraction or into a diesel fraction and a lower boiling fraction and thereafter in a second fractionator fractionating the higher boiling fraction to produce an intermediate fraction and a diesel fraction or fractionating the lower boiling fraction to produce an intermediate fraction and a gasoline fraction.

2. A process for producing fractions from a catalytic hydrocarbon as claimed in claim 1, wherein the intermediate fraction is obtained from one or more side cuts at the middle section of a single fractionator.

3. A process for producing fractions from a catalytic hydrocarbon as claimed in claim 2, wherein the fractionator has an overhead temperature of 65-95, an outlet temperature of diesel fuel of 190-280, a temperature of the side cuts is 120~260, a bottom temperature is 340~385, an overhead pressure of the fractionator of 0.11~0.28 Mpa, and a bottom pressure of the fractionator of 0.12~0.30 Mpa.

4. A process for producing fractions from a catalytic hydrocarbon as claimed in claim 1, wherein the fractionation is a two-step fractionation: first step, fractionate a gasoline fraction and a diesel fuel fraction, increase the temperature of the fractionator by 10~15, control the distillation range of the gasoline fraction 1 at 35~210±30, and control the distillation range of the diesel fuel fraction at 210±30~355±30; pump the gasoline fraction to the second fractionator for secondary fractionation, an intermediate fraction with the distillation range of 110±30~210±30 is drawn from the bottom of the second fractionator, and a gasoline fraction with the distillation range of 35~110±30 is drawn from the overhead thereof.

5. A process for producing fractions from a catalytic hydrocarbon as claimed in claim 1, wherein the fractionation is a two-step fractionation: first step, fractionate a gasoline fraction and a diesel fuel fraction, reduce the temperature of the first fractionator down 10~40, control the distillation range of the gasoline fraction at 35~110±30, and control the distillation range of the diesel fuel fraction 1 at 110±30 ~355±30; pump the diesel fuel fraction to a second fractionator for secondary fractionation, a diesel fuel fraction with the distillation range of 210±30~355±30 is drawn from the bottom of the second fractionator, and an intermediate fraction with the distillation range of 110±30~210±30 is drawn from the overhead thereof.

6. A process for producing fractions from a catalytic hydrocarbon as claimed in claim 1, wherein the aromatic hydrocarbon fraction obtained by solvent extraction is fractionated, to produce at least an overhead cut and bottoms and a high octane number gasoline fraction is separated from the overhead cut of said fractionation, and a heavy aromatic hydrocarbon fraction is separated from the bottoms thereof; and the high octane number gasoline fraction blended with the gasoline fraction, and the heavy aromatic hydrocarbon fraction blended with the diesel fuel fraction.

7. A process for producing fractions from a catalytic hydrocarbon as claimed in claim 2, wherein 1 to 4 side cuts are obtained from the middle section of the fractionator to divide the intermediate fraction into 1~4 distillation ranges.

8. A process for producing fractions from a catalytic hydrocarbon as claimed in claim 1, wherein the aromatic hydrocarbon fraction is used as high quality gasoline directly.

9. A process for producing fractions from a catalytic hydrocarbon as claimed in claim 1, wherein the non-aromatic hydrocarbon fraction is fractionated at a further fractionator, a diesel fuel fraction is separated from the bottom of the further fractionator, and blended with the diesel fuel fraction from the first fractionator or the second fractionator fractionation to increase the cetane number of the diesel fuel, or make one or more grades of low condensing point diesel fuel; light non-aromatic hydrocarbons are separated from the overhead of the further fractionator.

10. A process for producing fractions from a catalytic hydrocarbon as claimed in claim 1, wherein one or more side cuts are obtained from the middle section of the first fractionator to provide an intermediate fraction; separation of the gasoline fraction, the diesel fuel fraction and the intermediate fraction being completed at the first fractionator; the distillation range of the gasoline fraction is controlled at 35~150, the distillation range of the diesel fuel fraction is controlled at 170~395, the distillation range of the intermediate fraction is controlled at 70~250.

11. A process for producing fractions from a catalytic hydrocarbon as claimed in claim 1, wherein 2 to 4 side cuts are obtained from the middle section of the fractionator, so as to divide the intermediate fraction into 2 to 4 streams.

12. A process for producing fractions from a catalytic hydrocarbon as claimed in claim 11, wherein the fractionator has an overhead temperature of 65~130, diesel fuel outlet temperature of 170~250, a side cut temperature of 120~240, a bottoms temperature of the fractionator of 330~385, and the fractionator has an overhead pressure of 0.15~0.28 MPa, a bottom pressure of 0.12~0.30 MPa.

13. A process for producing fractions from a catalytic hydrocarbon as claimed in claim 1, wherein the fractionation is a two-step fractionation wherein: in the first step said catalytic hydrocarbon is fractionated in said first fractionator to produce a gasoline fraction and a diesel fuel fraction,; the distillation range of the gasoline fraction is controlled at 35~250, the distillation range of the diesel fuel fraction is controlled at 170~395; the gasoline fraction is pumped to the second fractionator for secondary fractionation, wherein an intermediate fraction with the distillation range of 70~250 is drawn from the bottom of the second fractionator, a gasoline fraction with the distillation range of 35~150 is drawn from the overhead thereof; the intermediate fraction and the gasoline fraction with the distillation range of 35~150 are pumped to a solvent extraction unit to separate aromatic hydrocarbon fraction and non-aromatic hydrocarbon fraction.

14. A process for producing fractions from a catalytic hydrocarbon as claimed in claim 1, wherein the fractionation is a two-step fractionation wherein: in the first step said catalytic hydrocarbon is fractionated in said first fractionator to produce a gasoline fraction and a diesel fuel fraction; the distillation range of the gasoline fraction is controlled at 35~150, the distillation range of the diesel fuel fraction is controlled at 70~395; the diesel fuel fraction is pumped to a second fractionator for secondary fractionation, a diesel fuel fraction with the distillation range of 170~395 is drawn from the side cuts of the second fractionator, an intermediate fraction with the distillation range of 70~250 is drawn from overhead thereof; and the intermediate fraction and the diesel fuel fraction with the distillation range of 170~395 are pumped to a solvent extraction unit to separate aromatic hydrocarbon fraction and non-aromatic hydrocarbon fraction.

15. A process for producing fractions from a catalytic hydrocarbon as claimed in claim 1 wherein the aromatic hydrocarbon fraction obtained by solvent extraction is fractionated, and a high octane number gasoline fraction is separated from overhead of said fractionation, a heavy aromatic hydrocarbon fraction is separated from bottoms thereof; and the non-aromatic fraction obtained by solvent extraction is also fractionated to produce light gasoline as overhead light non-aromatic hydrocarbons as side cuts; and a diesel fuel fraction as bottoms.

16. A process for producing fractions from a catalytic hydrocarbon as claimed in claim 1, wherein the aromatic hydrocarbon fraction is used as high quality gasoline without further processing.

17. A process for producing fractions from a catalytic hydrocarbon as claimed in claim 15, wherein the high octane number gasoline fraction is blended with the light gasoline fraction.

18. A process for producing fractions from a catalytic hydrocarbon as claimed in claim 15, wherein the heavy aromatic hydrocarbon fraction is blended with the diesel fuel fraction.

19. A process for producing fractions from a catalytic hydrocarbon as claimed in claim 15, wherein the diesel fuel fraction is blended with the diesel fuel fraction.

20. A process for producing fractions from a catalytic hydrocarbon as claimed in claim 15, wherein the light non-aromatic hydrocarbon fraction is blended with the gasoline fraction.

21. A process for producing fractions from a catalytic hydrocarbon as claimed in claim 15, wherein the heavy aromatic hydrocarbon fraction is used as an independent product; the diesel fuel fraction serves as feed for ethylene production after being hydrogenated; and the light non-aromatic hydrocarbon fraction is used as chemical light oils.

22. A process for producing fractions from a catalytic hydrocarbon as claimed in claim 15, wherein the high octane number gasoline fraction is blended with the light gasoline fraction and the light non-aromatic hydrocarbons.

23. A process for producing fractions from a catalytic hydrocarbon as claimed in claim 1, wherein water-soluble solvent used for extraction is recycled, regeneration of the water-soluble solvent being effected by: 1) mixing the water-soluble solvent with water, the weight ratio of water and the water-soluble solvent being 0.1-10; 2) separating the mixture by sedimentation wherein three phases are formed, the top layer being oil, the middle layer being a mixture of water-soluble solvent and water, and the lower layer being insoluble substance; 3) distilling the middle mixed phase in step 2) at atmospheric pressure or under a vacuum to obtain regenerated water-soluble solvent and water; 4) discharging the regenerated water-soluble solvent in 3), cooling the separated water; 5) after cooling the water in 4) reseparating to divide water and oil, discharging the recovered water, and mixing with the water-soluble solvent in 1) for recycling use.

24. A process for producing fractions from a catalytic hydrocarbon as claimed in claim 23, wherein the mixed phase in step 3) is filtered before distillation.

25. A process for producing fractions from a catalytic hydrocarbon as claimed in claim 23, wherein the weight ratio of the water and the water-soluble solvent is 0.5-3.

26. A process for producing fractions from a catalytic hydrocarbon as claimed in claim 23, wherein the weight ratio of the water and the water-soluble solvent is 1-2.

27. A process for producing fractions from a catalytic hydrocarbon as claimed in claim 23, wherein the water-soluble solvent includes a mixed solvent of 2 or more water-soluble solvents.

28. A process for producing fractions from a catalytic hydrocarbon as claimed in claim 23, wherein the mixed phase in step 3) is filtered more than once before distillation.

29. A process for producing fractions from a catalytic hydrocarbon as claimed in claim 28, wherein said mixed phase is filtered in a 2-stage filtration.

30. A process for producing fractions from a catalytic hydrocarbon as claimed in claim 28, wherein said mixed phase is filtered in a 3-stage filtration.

31. A process for producing fractions from a catalytic hydrocarbon as claimed in claim 29, wherein said mixed phase is filtered in series.

* * * * *